US009248063B2

(12) United States Patent
Wang

(10) Patent No.: US 9,248,063 B2
(45) Date of Patent: Feb. 2, 2016

(54) DEVICE FOR TURNING OVER AND TRANSFERRING THE PATIENT

(71) Applicant: Yi-Long Wang, Keelung (TW)

(72) Inventor: Yi-Long Wang, Keelung (TW)

( * ) Notice: Subject to any disclaimer, the term of this patent is extended or adjusted under 35 U.S.C. 154(b) by 279 days.

(21) Appl. No.: 13/904,242

(22) Filed: May 29, 2013

(65) Prior Publication Data

US 2013/0318708 A1 Dec. 5, 2013

(30) Foreign Application Priority Data

May 30, 2012 (TW) ..... 101119329 A

(51) Int. Cl.
*A61G 7/10* (2006.01)
*A61G 7/00* (2006.01)

(52) U.S. Cl.
CPC ..... *A61G 7/1003* (2013.01); *A61G 7/001* (2013.01); *A61G 7/1019* (2013.01); *A61G 7/1046* (2013.01); *A61G 7/1051* (2013.01); *A61G 7/1055* (2013.01); *A61G 7/1067* (2013.01)

(58) Field of Classification Search
CPC . A61G 7/1003; A61G 7/1055; A61G 7/1067; A61G 7/1051; A61G 7/001; A61G 7/1046; A61G 7/1048; A61G 7/1019; A61G 7/10; A61G 7/1001; A61G 7/1007; A61G 7/1013; A61G 7/1015; A61G 7/107; A61G 7/1023; A61G 7/1076
See application file for complete search history.

(56) References Cited

U.S. PATENT DOCUMENTS 5,810,104 A * 9/1998 Campbell ..... B62D 51/04 180/19.2
5,946,748 A * 9/1999 Wang ..... A61G 7/1015 212/281
6,321,398 B1 * 11/2001 Wang ..... A61G 7/001 212/901
7,611,203 B1 * 11/2009 Roberts ..... A61G 7/1011 297/217.7
8,914,920 B2 * 12/2014 Niklasson ..... A61G 7/1017 5/83.1
2004/0148699 A1 * 8/2004 Fernie ..... A61G 7/1017 5/86.1
2004/0232396 A1 * 11/2004 Ming-Hwa ..... A61G 7/1003 254/8 R
2007/0000049 A1 * 1/2007 White ..... A61G 7/1015 5/84.1
2007/0240260 A1 * 10/2007 White ..... A61G 7/1017 5/81.1 R
2008/0189852 A1 * 8/2008 Gramkow ..... A61G 7/1015 5/85.1
2008/0301873 A1 * 12/2008 White ..... A61G 7/001 5/85.1
2009/0307841 A1 * 12/2009 James ..... A61G 7/001 5/88.1
2010/0005585 A1 * 1/2010 Spidare ..... A61G 7/1017 5/83.1
2010/0192297 A1 * 8/2010 Gramkow ..... A61G 7/1019 5/87.1
2010/0224841 A1 * 9/2010 Liljedahl ..... A61G 7/1017 254/120
2010/0229299 A1 * 9/2010 Lear ..... A61G 7/1015 5/89.1
2012/0090090 A1 * 4/2012 Aabakken ..... A61G 7/1044 5/87.1

* cited by examiner

*Primary Examiner* — David E Sosnowksi
(74) *Attorney, Agent, or Firm* — Rosenberg, Klein & Lee

(57) ABSTRACT

A device for turning over and transferring the patient comprises a base, a lifting mechanism, an extension arm, a cantilever beam, and a turn driving device. The lifting mechanism comprises a lifting post and a lift driving device. The lifting post is fixed to the base; the lift driving device is fixed to the lifting post. The extension arm has a first end and a second end. The lift driving device is operatively connected to the first end for driving the extension arm to move up and down along the lifting post. The cantilever beam is connected to the second end and extending away from the lifting post. The turn driving device comprises a motor reducer, a revolutionary shaft, and two turning shafts.

9 Claims, 26 Drawing Sheets

DEVICE FOR TURNING OVER AND TRANSFERRING THE PATIENT

FIELD OF THE INVENTION

The present invention relates generally to a device for turning over and transferring the patient, and particularly to a medical assistive device for care and rehabilitation applications.

BACKGROUND OF THE INVENTION

In the coming aged society, the bodies of many apoplexy patients, patients in the vegetative state, or bedridden patients degenerate due to lack of activities. If not turned periodically, they may suffer from bedsores. Thereby, caregivers and care equipment are required for their daily cares. It is a tiresome and heavy duty to take care a bedridden patient in a long time. For improving the caring abilities as well as relieving the burden of labor for caregivers, convenient and labor-saving care and rehabilitation apparatuses are highly required.

Currently, the care and rehabilitation apparatuses for caring bedridden patients in the market include:

1. Turning bed: includes a single application of turning a bedridden patient.
2. Inflatable bed: includes a single application of changing the pressure points of the body of a bedridden patient for preventing bedsores.
3. Electric shifting machine: includes the application of moving and weighing a bedridden patient.
4. Phlegm suction machine: includes a single application of phlegm suction for a bedridden patient's mouth, nose, throat, or shallow trachea.
5. Shampooing basin: includes a single application of shampooing a bedridden patient's hair in bed.
6. Bath machine: includes a single application of moving a patient to the bathroom for bathing.
7. Rehabilitation machine for hands and legs: includes a single application of rehabilitating the hands and legs of an apoplexy patient.
8. Weighing frame: includes a single application of slinging a patient for weighing.
9. Rehabilitative walking machine: includes a single application of rehabilitating an apoplexy patient by walking.
10. "Multipurpose body-turn-over apparatus" by the present inventor (Taiwan utility patent publication number 387249; U.S. Pat. No. 6,321,398 B1):
    (1) Only the lateral (the left and right direction of the patient) turning rod is designed; no longitudinal (the head and leg direction of the patient) turning rod is available. Hence, there is no lateral turning operations such as slinging the wheelchair in the sit position or turning laterally for lifting the hip and the chest.
    (2) The male shell of the lifting frame slips into the female shell for moving up and down. Because the female shell has a basic length, the lifting range is relatively high. Due to the limited lifting path, the demand is not practically satisfied.
    (3) The net having a folding board inside hooks the sling for turning. However, the folding board has the disadvantages of increasing cost, heaviness, interference, and uneasy to fold and clean.
11. "Assistive turning device having lifting function" (Taiwan utility patent publication number M416461: The lifting mechanism and the turning device are different from the present invention.

Although the various care apparatuses for apoplexy patients, patients in the vegetative state, or bedridden patients described above have respective functions, there is no an integrated device for caring. In addition to higher purchasing costs, they occupy space. Besides, they cannot satisfy the overall demands of home care and rehabilitation.

SUMMARY

For solving the problems in the prior art, the present invention provides a device for turning over and transferring the patient. The device according to an embodiment of the present invention comprises a base, a lifting mechanism, an extension arm, a cantilever beam, and a turn driving device. The lifting mechanism comprises a lifting post and a lift driving device. The lifting post is fixed to the base; the lift driving device is fixed to the lifting post. The extension arm has a first end and a second end. The lift driving device is operatively connected to the first end for driving the extension arm to move up and down along the lifting post. The cantilever beam is connected to the second end and extending away from the lifting post. The turn driving device comprises a motor reducer, a revolutionary shaft, and two turning shafts. The motor reducer is connected pivotally to the cantilever beam. The revolutionary shaft is connected to the motor reducer; the revolutionary shaft rotates when it is driven by the motor reducer. The two turning shafts are fixed to both ends of revolutionary shaft, respectively, and turned relative to the motor reducer as the revolutionary shaft rotates.

The device for turning over and transferring the patient according to another embodiment of the present invention comprises a base, a lifting mechanism, an extension arm, a cantilever beam, a turn driving device, and a bed-shaped mattress. The lifting post is fixed to the base. The extension arm has a first end and a second end. The first end is operatively connected to the lifting mechanism. The cantilever beam is connected to the second end and extending away from the lifting post. The turn driving device comprises a motor reducer, a revolutionary shaft, and two turning shafts. The motor reducer is connected pivotally to the cantilever beam. The revolutionary shaft is connected to the motor reducer; the revolutionary shaft rotates when it is driven by the motor reducer. The two turning shafts are fixed to both ends of revolutionary shaft, respectively, and turned relative to the motor reducer as the revolutionary shaft rotates. The bed-shaped mattress comprises a main pad and a head pad. The head pad is connected to the edge of the main pad. The main pad and the head pad comprise a plurality pairs of pad lugs. Each pair of pad lugs is disposed on both sides of the main pad or the head pad symmetrically. Each pair of pad lugs can be hung to the turning shaft selectively by means of at least a sling.

The device for turning over and transferring the patient according to still another embodiment of the present invention comprises a base, a lifting mechanism, an extension arm, a cantilever beam, a turn driving device, an assembly frame, and a bathing tub. The lifting post is fixed to the base. The extension arm has a first end and a second end. The first end is operatively connected to the lifting mechanism. The cantilever beam is connected to the second end and extending away from the lifting post. The turn driving device comprises a motor reducer, a revolutionary shaft, and two turning shafts. The motor reducer is connected pivotally to the cantilever beam. The revolutionary shaft is connected to the motor reducer; the revolutionary shaft rotates when it is driven by the motor reducer. The two turning shafts are fixed to both ends of revolutionary shaft, respectively, and turned relative to the motor reducer as the revolutionary shaft rotates. The assembly frame comprises a plurality of fixing posts and a plurality of frame lugs. The frame lugs are hung to the turning shaft by means of at least a sling. The bathing tub comprises a plurality of fixing belts; each fixing belt is fixed to the corresponding fixing post.

To sum up, the device for turning over and transferring the patient according to the present invention is provided mainly for achieving the purpose of integrated cares for the apoplexy patients, the patients in the vegetative state, or the bedridden patients. The device for turning over and transferring the patient according to the present invention mainly comprises a base, a lifting mechanism, an extension arm, a cantilever beam, and a turn driving device, which can be disassembled and assembled. Specifically, the device for turning over and transferring the patient according to the present invention can switch between lateral (the left and right direction) and longitudinal (the head and leg direction) turning functions by means of the revolutionary shaft and the turning shafts contained in the turn driving device. In addition to being used with the bed-shaped mattress and the sling (including slings of various functions) described above, the device for turning over and transferring the patient according to the present invention can also be used with hooks (including hooks on the turning shafts and hooks on the slings), pulling handles, leg-lifting boards, bottom-washing tray, hair-washing tray, on-bed bathing tub, washing tools, assemble frames, vest slings. Under the instructions of professional physicians as well as safe and appropriate operations, the following purposes can be achieved:

1. Patients can perform turning exercise or the side lying positions of patients can be altered periodically, namely, changing the pressure point, for preventing bedsores.
2. Patients on bed can be slung highly for facilitating moving, changing bed sheets, or placing other accessories.
3. Caregivers can clean patients' hair on bed.
4. Caregivers can wash patients on bed.
5. Caregivers can clean patients' fecal matters, wash patients' bottoms, and change diapers on bed.
6. Caregivers can operate independently. Besides, the bed-shaped mattress can be placed anywhere for slinging patients to wheelchairs or back to beds.
7. Caregivers can percuss patients for expelling phlegm deep inside lower lungs to noses or mouths. Then use suction machines to draw out the phlegm.
8. Caregivers can raise and lower patients' legs repeatedly on bed for rehabilitation.
9. Caregivers can help patients to grip handles while pulling and releasing patients' both arms simultaneously or pulling and releasing patients' single arm alternately on bed.
10. Caregivers can help patients to practice sitting using their upper bodies, lying down, or standing up and sitting down on bedsides.

In addition, according to an embodiment of the present invention, the lifting mechanism described above further comprises an insertion socket and a lifting socket. The insertion socket is provided so that the first end of the extension arm can insert thereto. The lift driving device is connected to the insertion socket for driving the insertion socket to drive the extension arm to move up and down with respect to the lifting post. The lifting socket is put around the lifting post and fixed together with the insertion socket, making them to move up and down along the lifting post. The lifting post passes through both ends of the lifting socket.

Accordingly, the device for turning over and transferring the patient according to the present invention has the hollow lifting socket around the lifting post to make the lifting socket move up and down between two ends of the lifting post. In compared with the method according to the prior art, which has the lifting frame moving up and down by slipping the top male shell into the bottom female shell as described above, the combination of the lifting socket and post according to the present invention can increase the lifting range effectively, and thus making it more suitable for practical applications.

DETAILED DESCRIPTION

In order to make the structure and characteristics as well as the effectiveness of the present invention to be further understood and recognized, the detailed description of the present invention is provided as follows along with embodiments and accompanying figures.

Figure 1A:
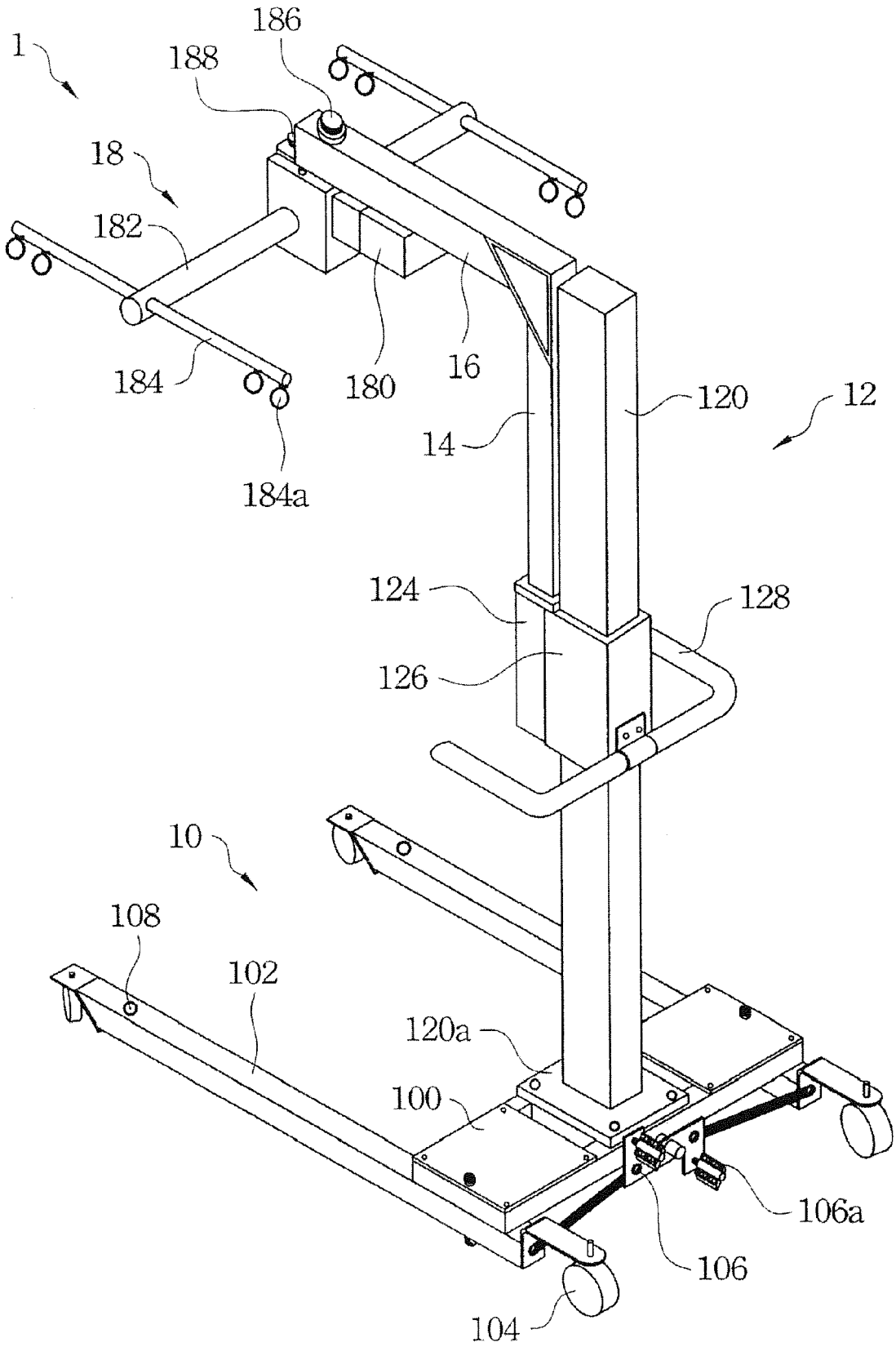
FIG. 1A shows a three-dimensional view of the device for turning over and transferring the patient according to an embodiment of the present invention.
Figure 1B:
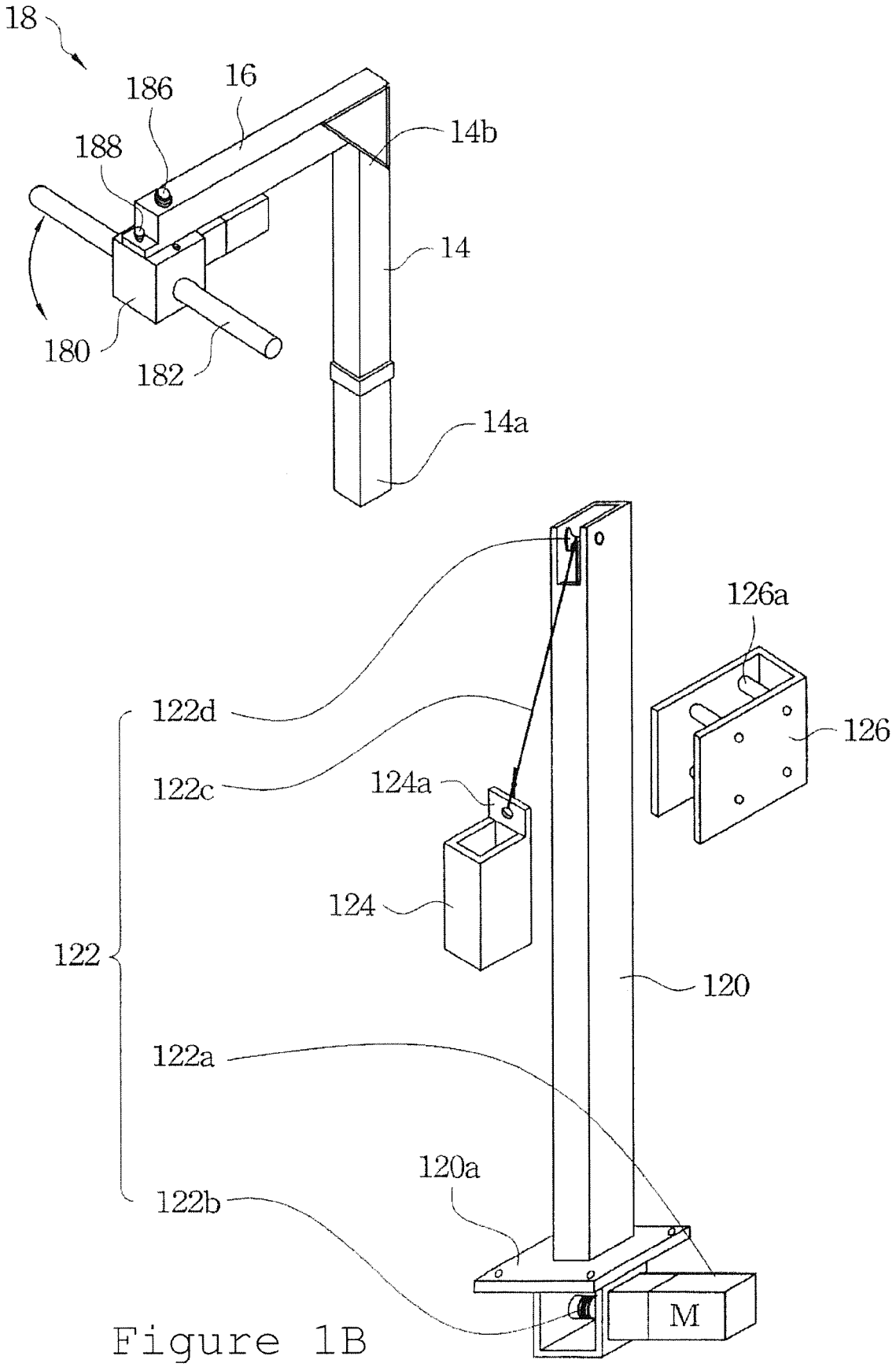
FIG. 1B shows a partial exploded view of the device for turning over and transferring the patient in FIG. 1A.
Figure 1C:
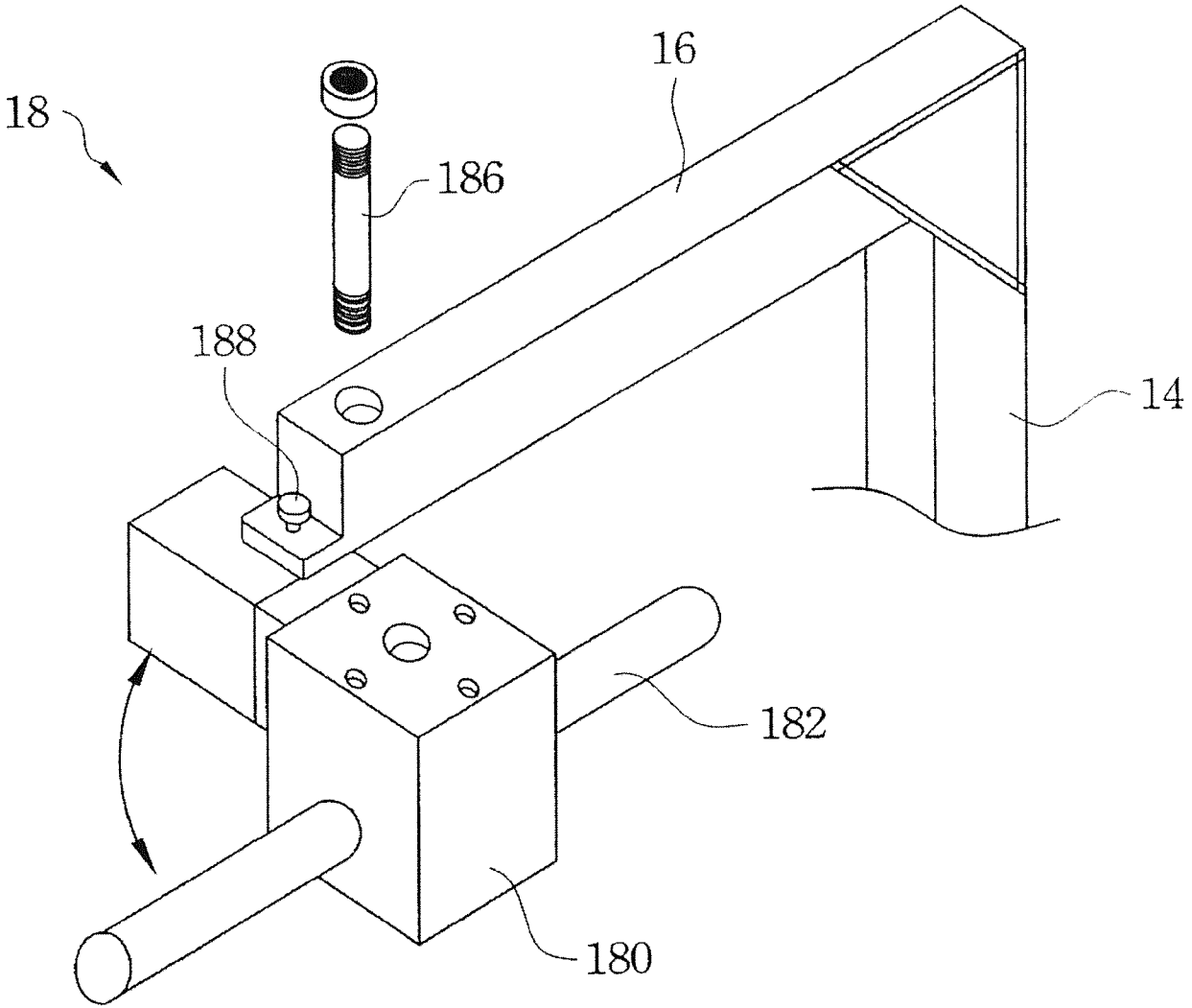
FIG. 1C shows a partial exploded view of the device for turning over and transferring the patient in FIG. 1A.

Please refer to FIGS. 1A, 1B, and 1C. FIG. 1A shows a three-dimensional view of the device for turning over and transferring the patient according to an embodiment of the present invention; FIG. 1B shows a partial exploded view of the device in FIG. 1A; and FIG. 1C shows a partial exploded view of the device in FIG. 1A.

As shown in FIG. 1A and FIG. 1B, a device 1 for turning over and transferring the patient according to the present embodiment comprises a base 10, a lifting mechanism 12, an extension arm 14, a cantilever beam 16, and a turn driving device 18. The base 10 of the device 1 comprises a base box 100, base crossbeams 102, wheels 104, a crossbeam spreading mechanism 106, pedals 106*a*, and pedal switches 108. The base crossbeams 102 of the base 10 are disposed on both sides of the base box 100, respectively. The wheels 104 of the base 10 are disposed at the front and the rear ends of the base crossbeams 102 and can be locked selectively. The lifting mechanism 12 of the device 1 comprises a lifting post 120, a lift driving device 122, an insertion socket 124, a lifting socket 126, and a handling frame 128. The lifting post 120 of the lifting mechanism 12 includes a connecting plate 120*a*. Hence, the lifting post 120 can be locked to the base box 100 of the base 10 via the connecting plate 120*a*. The lift driving device 122 of the lifting mechanism 12 is fixed to the lifting post 120 and comprises a motor reducer 122*a*, a scrolling device 122*b*, a lifting cable 122*c*, and a fixed pulley 122*d*. The motor reducer 122*a* and the scrolling device 122*b* of the lift driving device 122 are disposed under the connecting plate 120*a*. The fixed pulley 122*d* of the lift driving device 122 is disposed on the top of the lifting post 120. The lifting cable 122*c* of the lift driving device 122 is connected to the scrolling device 122*b*, passing into the lifting post 120 from the bottom of the lifting post 120, and guided into and then out of the fixed pulley 122*d* on the top of the lifting post 120. The insertion socket 124 of the lifting mechanism 12 has a handle 124*a*. The lifting cable 122*c* of the lift driving device 122 passes through the handle 124*a* of the insertion socket 124. Nonetheless, the present invention is not limited to this. The lifting cable 122*c* described above can be replaced by a lifting belt, a lifting chain, or similar devices. The lifting socket 126 of the lifting mechanism 12 is put around the lifting post 120. Besides, the lifting post 120 emerges from both ends of the lifting socket 126. Furthermore, the lifting socket 126 of the lifting mechanism 12 includes rollers 126*a*; the lifting post 120 is clipped within the rollers 126*a*. In addition, the lifting socket 126 of the lifting mechanism 12 and the insertion socket 124 are fixed to each other. The handling frame 128 of the lifting mechanism is fixed to the lifting socket 126 with both ends bending toward the insertion socket 124. The extension arm 14 of the device 1 has a first end 14*a* and a second end 14*b*. The insertion socket 124 of the lifting mechanism 12 is used to be inserted by the first end 14*a* of the extension arm 14. The cantilever beam 16 of the device 1 is connected to the second end 14*b* of the extension arm 14 and extends the lifting post 120 of the lifting mechanism 12 to the direction away from the lifting post 120.

As shown in FIGS. 1B and 1C, the turn driving device of the device according to the present embodiment comprises a motor reducer 180, a revolutionary shaft 182, turning shafts 184, a bolt shaft 186, and an orientation plug 188. The bolt shaft 186 of the turn driving device 18 passes through the cantilever beam 16 of the device 1. The motor reducer 180 of the turn driving device 18 is connected pivotally with the cantilever beam 16 via the bolt shaft 186. According to the present embodiment, the axis of the bolt shaft 186 of the turn driving device 18 is roughly parallel with the extension arm 14 and the lifting post 120 of the lifting mechanism 12. The revolutionary shaft 182 of the turn driving device 18 is connected with and passing through the motor reducer 180. Besides, the axis of the revolutionary shaft 182 is roughly perpendicular to the axis of the bolt shaft 186. The two turning shafts 184 of the turn driving device 18 are fixed to both ends of the revolutionary shaft 182, respectively; the axis of each turning shaft 184 is roughly perpendicular to the axis of the revolutionary shaft 182. In other words, the motor reducer 180, the revolutionary shaft 182, and the turning shaft 184 of the turn driving device 18 can rotate about the axis of the bolt shaft and turn horizontally about the cantilever beam 16. The revolutionary shaft 182 and the turning shaft 184 can also rotate about the axis of the revolutionary shaft and turn vertically about the motor reducer 180. In addition, the orientation plug 188 of the turn driving device 18 passes through the cantilever beam 16. Thereby, after the motor reducer 180 rotates about the axis of the bolt shaft 186 and turns horizontally about the cantilever beam 16 to the required angle, the orientation plug 188 can be used for fixing the angle between the motor reducer 180 and the cantilever beam 16.

Figure 2A:
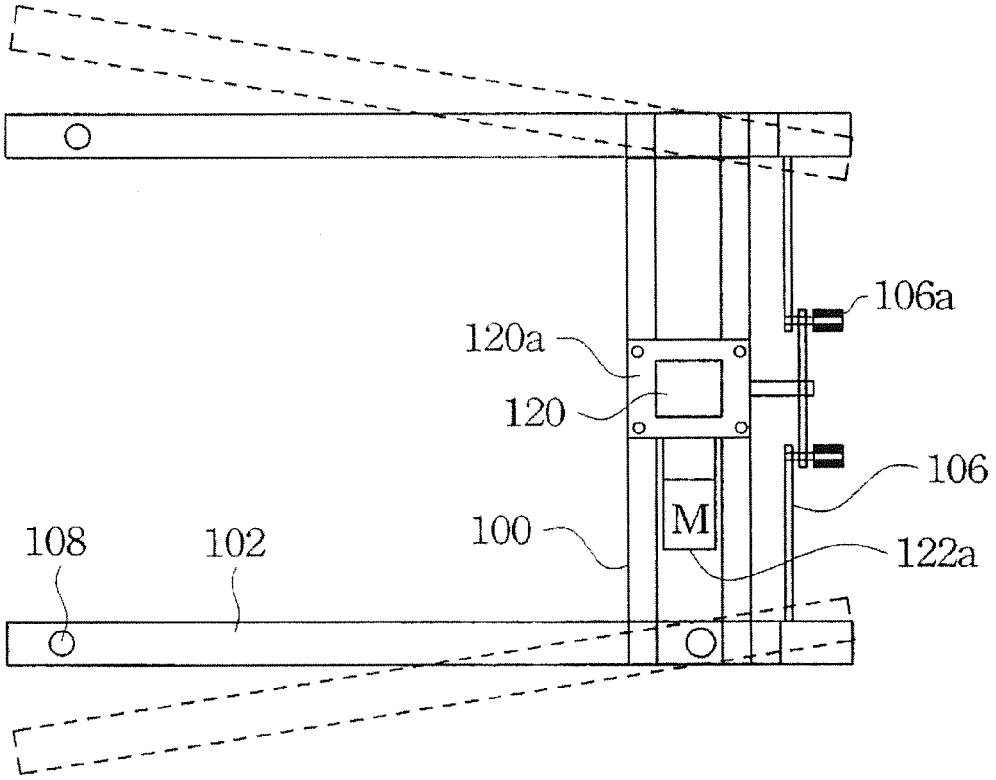
FIG. 2A shows a top view of the base in FIG. 1A.
Figure 2B:
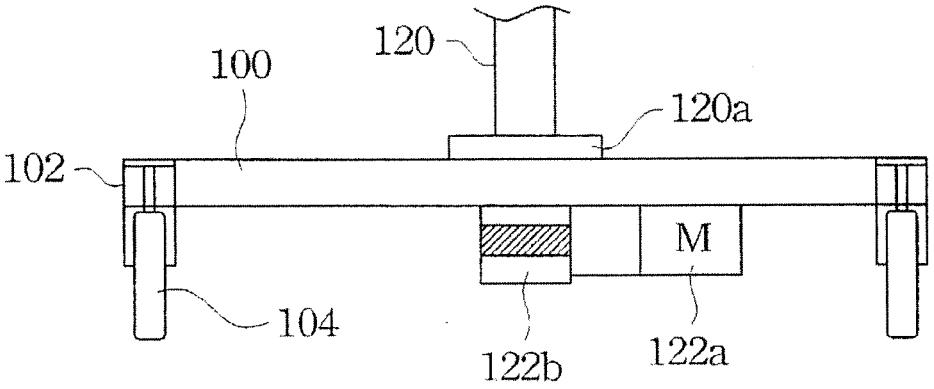
FIG. 2B shows a front view of the base in FIG. 1A.

Please refer to FIGS. 2A and 2B. FIG. 2A shows a top view of the base 10 in FIG. 1A; and FIG. 2B shows a front view of the base 10 in FIG. 1A.

As shown in FIGS. 2A and 2B, the spread of the base crossbeams on both sides of the base of the device according to the present embodiment can be adjusted by stamping the left and right pedals 106*a* of the crossbeam spreading mechanism 106. The connecting plate 120*a* of the lifting post 120 is locked on the base box 100 of the base 10. Thereby, the connecting plate 120*a* of the lifting post 120 is located above the base box 100; the motor reducer 122*a* and the scrolling device 122*b* of the lift driving device 122 locked to the connecting plate 120*a* are located below the base box 100.

Figure 3A:
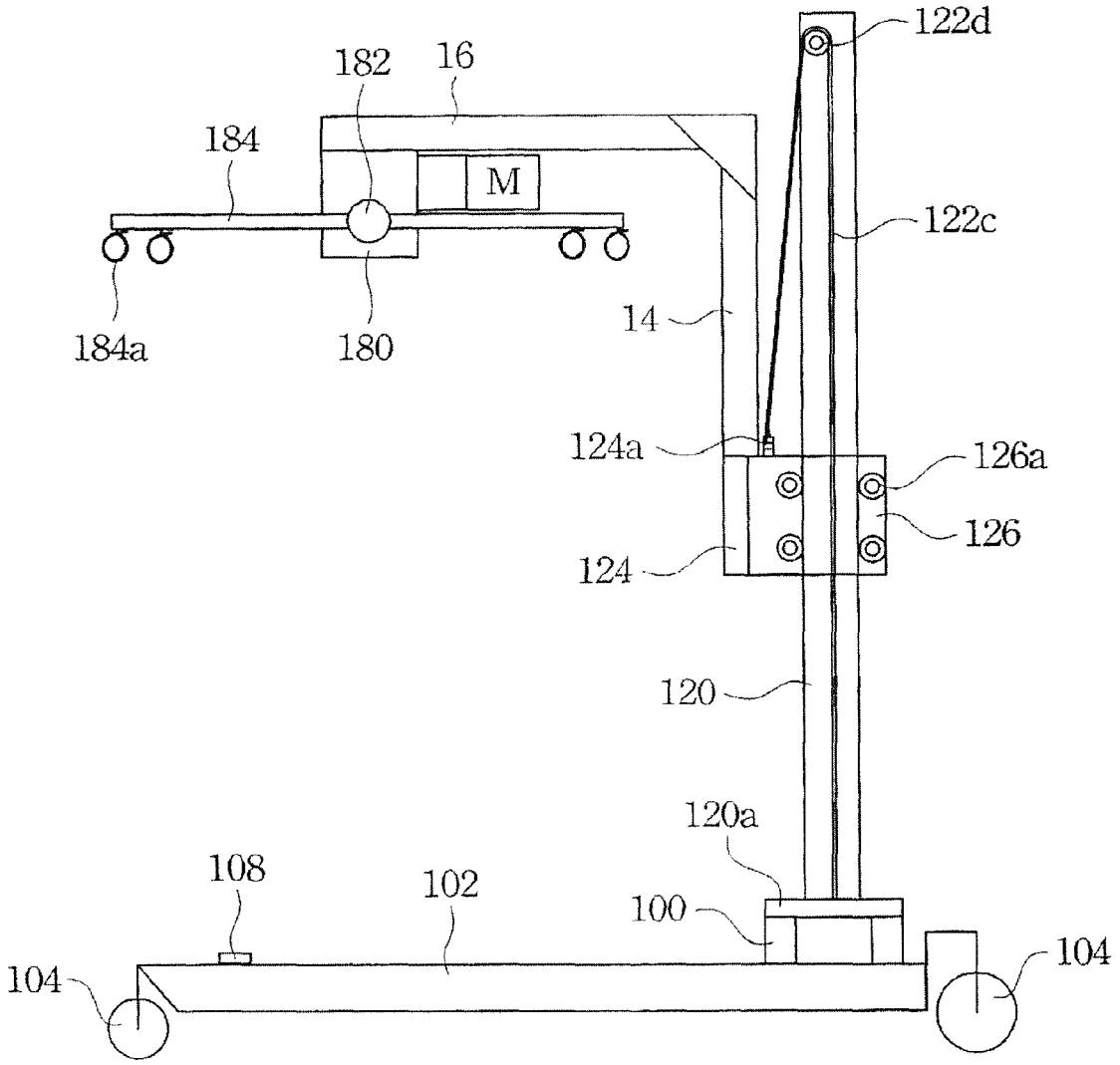
FIG. 3A shows a side view of the device for turning over and transferring the patient in FIG. 1A.
Figure 3B:
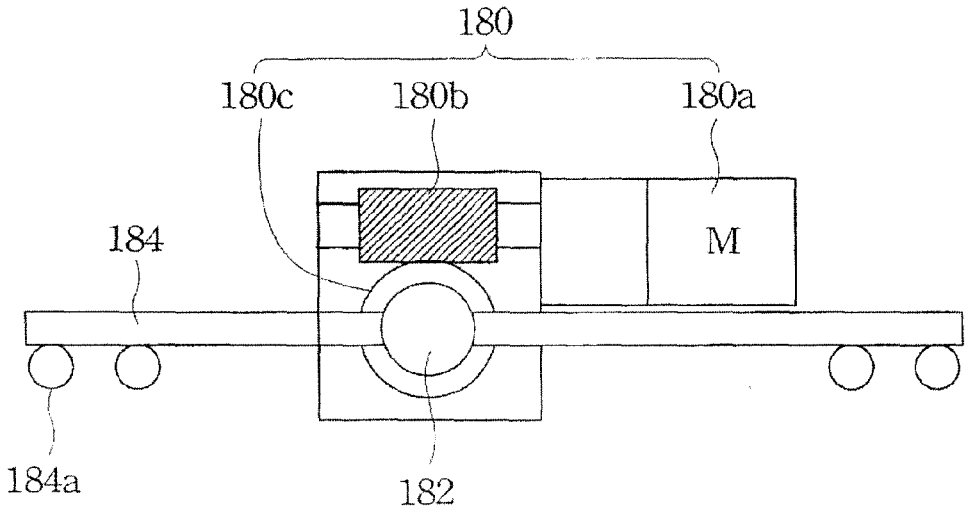
FIG. 3B shows a partial view of the turn driving device in FIG. 3A.

Please refer to FIGS. 3A and 3B. FIG. 3A shows a side view of the device in FIG. 1A; and FIG. 3B shows a partial view of the device in FIG. 3A.

As shown in FIGS. 3A and 3B, the device 1 according to the present embodiment uses the motor reducer 122*a* under the base box 100 of the base 10 to reduce the speed and rotate the scrolling device 122*b* to scroll the lifting cable 122*c*. Thereby, the lifting cable 122*c* can raise or lower the connected handle 124*a* via the fixed pulley 122*d* located on the top of the lifting post 120 and thus driving the lifting socket 126 to move up and down together with the insertion socket 124 along the lifting post 120 using its rollers 126*a*. Besides, the extension arm 14 inserted to the insertion socket 124 also moves up and down together with the insertion socket 124 along the lifting post 120. Thereby, the device 1 according to the present invention can adjust the location in height of the cantilever beam 16. In addition, according to the present embodiment, the motor reducer 180 of the turn driving device 18 comprises an electric motor 180*a*, a worm 180*b*, and a worm gear 180*c*. The motor reducer of the turn driving device 18 can use the electric motor 180*a* to rotate the worm 180*b* and drive the worm gear 180*c*, and hence driving the revolutionary shaft 182 to rotate about the motor reducer 180. Because the two turning shafts 184, whose lengths are adjustable, of the turn driving device 18 are fixed to both ends of the revolutionary shaft 182, respectively, the two turning shafts 184 will be turned together with the revolutionary shaft 182 about the motor reducer 180. Nonetheless, the transmission method of the motor reducer 180 for turning the revolutionary shaft 182 is not limited to the present embodiment.

Moreover, as shown in FIG. 1A and FIG. 3A, according to the present embodiment, the pedal switches 108 of the base 10 are disposed on the base crossbeam 102 for enabling the lifting mechanism 12 and operating the cantilever beam 16 to move up and down. However, the present invention is not limited to the embodiment. According to another embodiment, an extra manual controller can be adopted for enabling the lifting mechanism 12 and operating the cantilever beam 16 to move up and down.

Figure 4A:
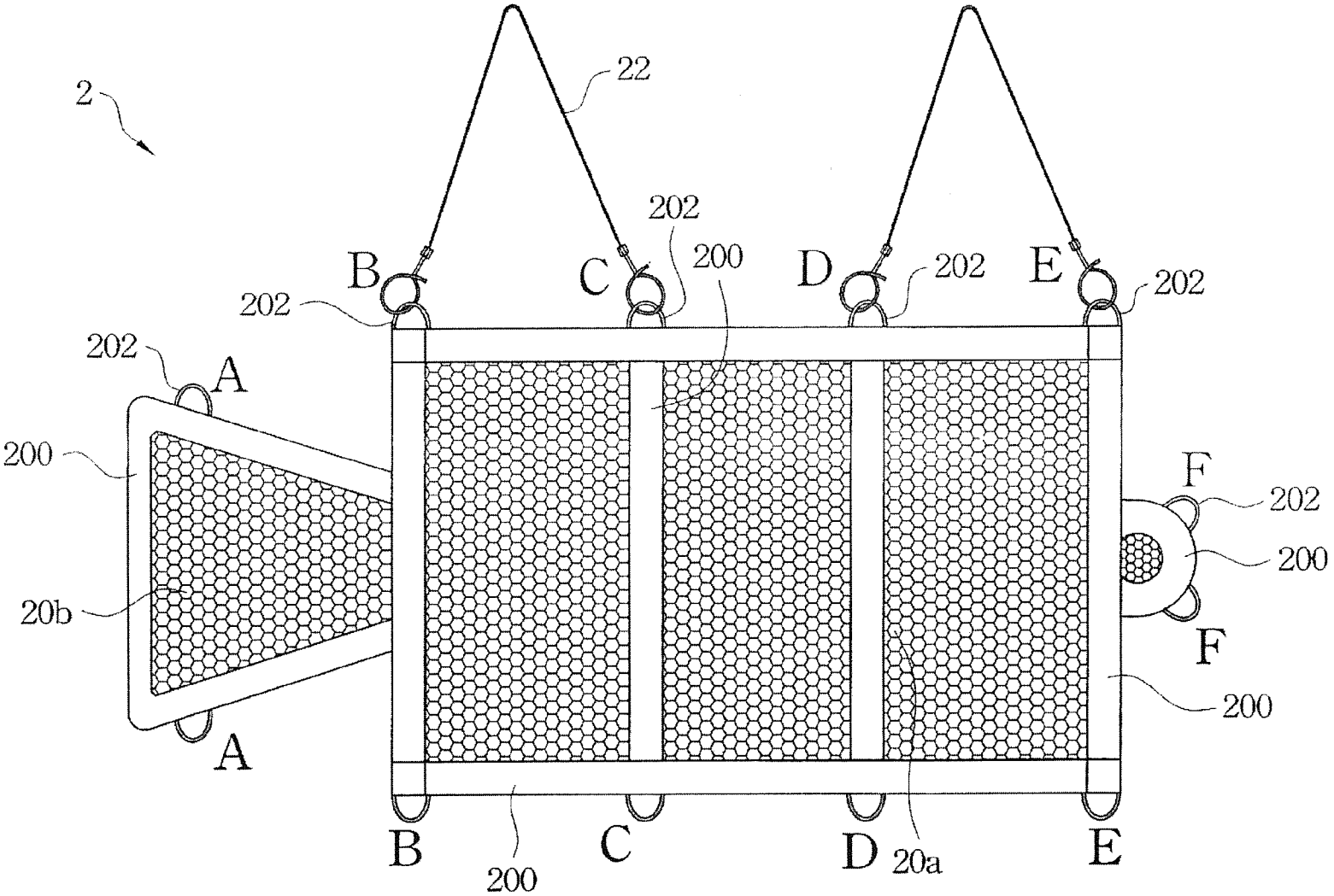
FIG. 4A shows a schematic view of the bed-shaped mattress used with the turning and lifting device in FIG. 1A.

Please refer to FIG. 4A, which shows a schematic view of the bed-shaped mattress used with the device in FIG. 1A.

As shown in FIG. 1A and FIG. 4A, according to the present embodiment, the bed-shaped mattress 2 applicable to the device 1 comprises a main pad 20*a* and a head pad 20*b*. The head pad 20*b* of the bed-shaped mattress 2 is connected to the edge of the main pad 20*a*. The main pad 20*a* of the bed-shaped mattress 2 and the head pad 20*b* comprise a plurality pairs of pad lugs 202. Each pair of the pad lugs 202 of the bed-shaped mattress 2 is disposed symmetrically on both sides of the main pad 20*a* or the head pad 20*b*. Besides, each pair of the pad lugs 202 of the bed-shaped mattress 2 can be selected to be slung to the turning shaft 184 via at least a sling 22. Furthermore, the turning shaft 184 of the turn driving device 18 includes a plurality of hooks 184*a*. Each pair of the pad lugs 202 of the bed-shaped mattress 2 can be selected to be slung to any hook 194*a* of the turning shaft 184 via the slings 22. According to the present embodiment, the head pad 20*b* has the A pad lugs 202 disposed symmetrically. After slung to the turning shaft 184, the head pad 20*b* can be used for supporting a patient's head. The main pad 20*a* has the B pad lugs 202, the C pad lugs 202, the D pad lugs 202, the E pad lugs 202, and the F pad lugs 202 disposed symmetrically. After slung to the turning shaft 184, the main pad 20*a* can be used for supporting a patient's shoulder, chest, waist, hips, and groin, respectively. The main pad 20*a* and the head pad 20*b* of the bed-shaped mattress 2 include a plurality of reinforcing bands stitched thereto. In addition, the pairs of pad lugs 202 described above are all disposed on the reinforcing bands 200. In particular, the reinforcing bands 200 of the main pad 20*a* and the head pad 20*b* of the bed-shaped mattress 2 are disposed on the peripheries. Because the main pad 20*a* has a larger area, it requires additional lateral reinforcing bands 200. Moreover, if the has pad 20*b* of the bed-shaped mattress 2 is not in use, it can be folded and adhered to the back of the main pad 20*a*.

Figure 4B:
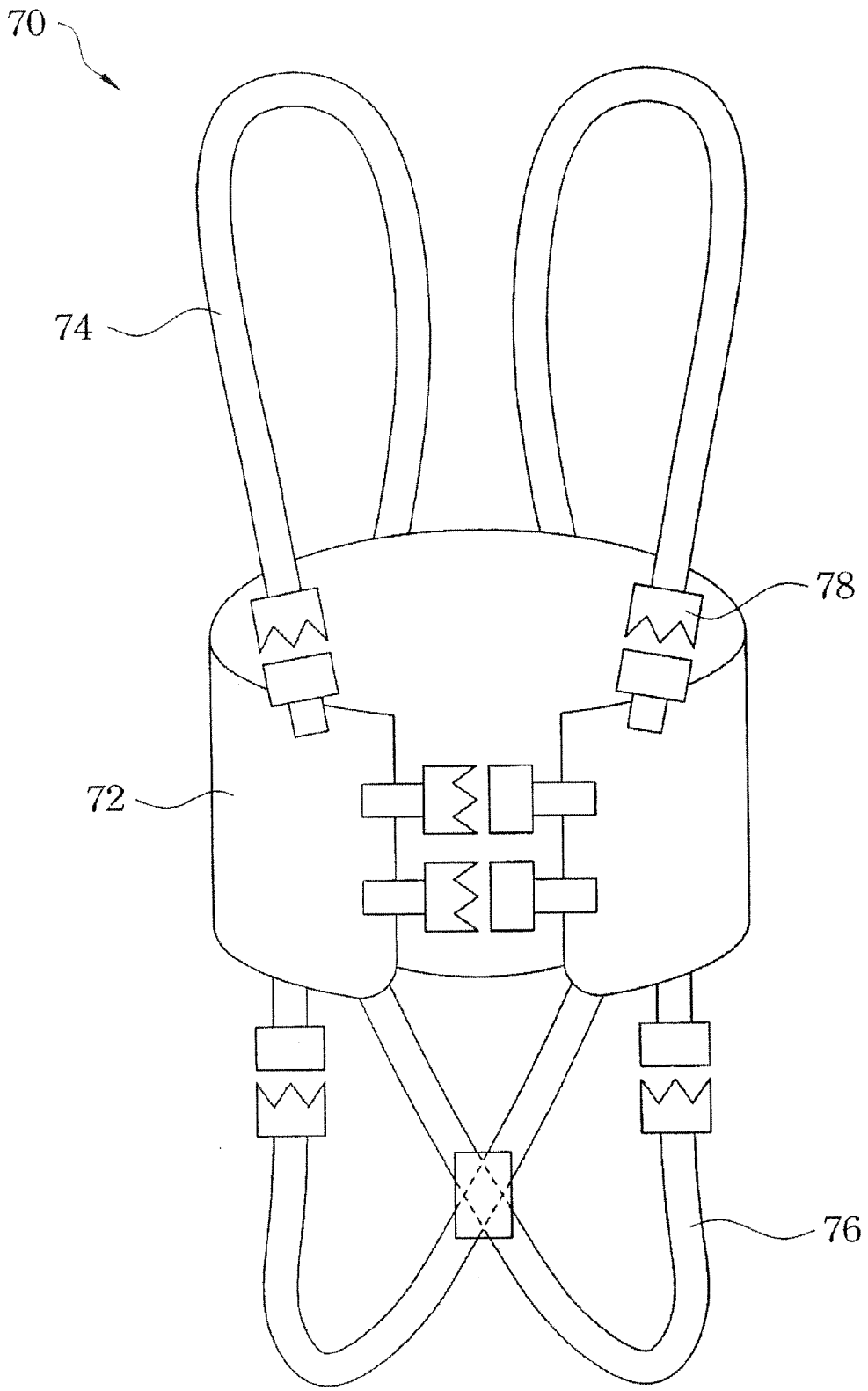
FIG. 4B shows a schematic view of the vest sling used with the device in FIG. 1A.

Please refer to FIG. 4B, which shows a schematic view of the vest sling used with the turning and lifting device in FIG. 1A.

As shown in FIG. 4B, according to the present embodiment, the vest sling 70 comprises a long pad 72, chest slings 74, bottom slings 76, and a plurality of male and female buckles 78. The chest slings 74, the bottom slings 76, and the male and female buckles 78 of the vest sling 70 are stitched to the upper and lower peripheries of the long pad 72 for supporting and protecting a patient's body during rehabilitation.

Figure 5A:
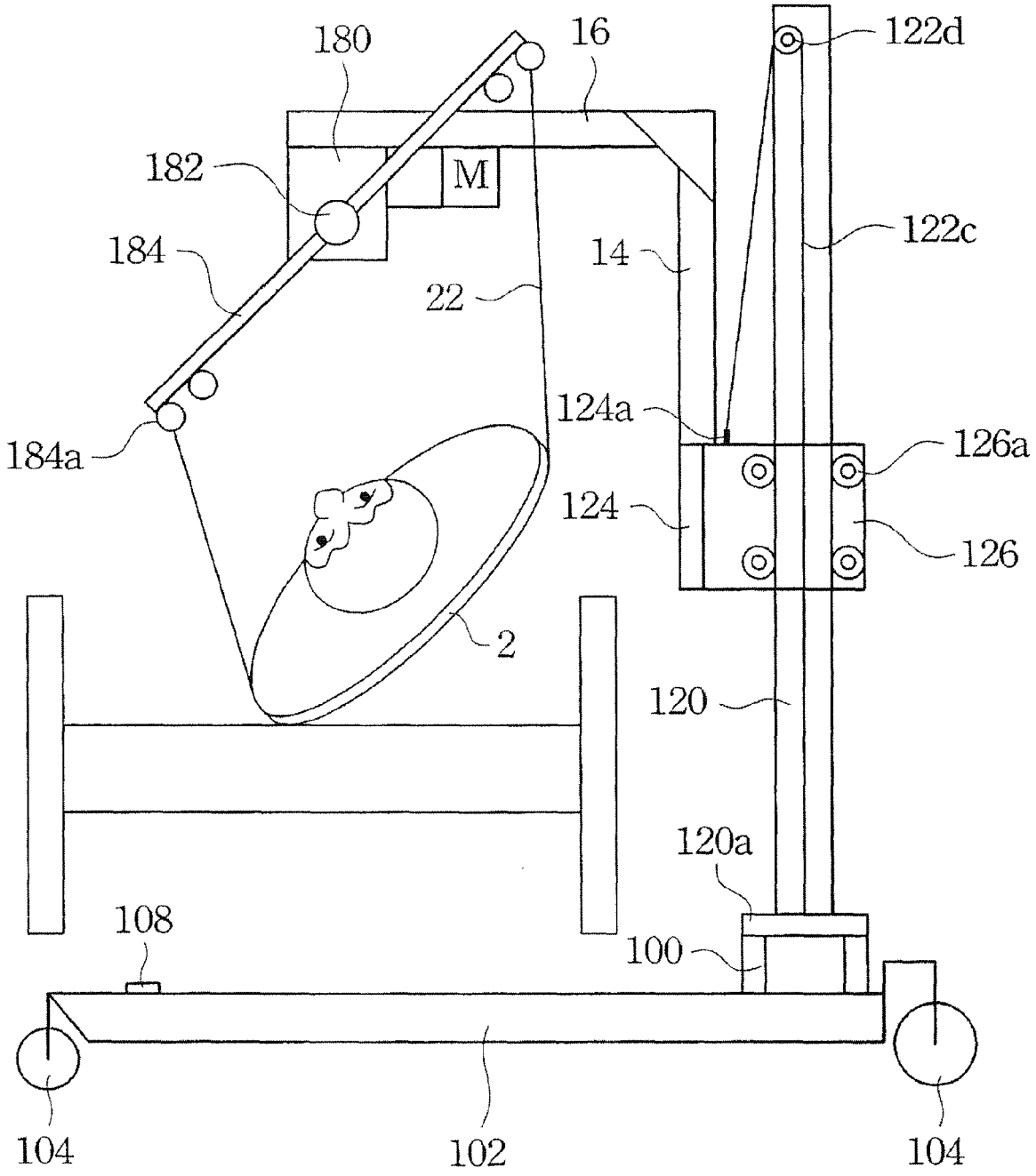
FIG. 5A shows a schematic diagram of turning on bed by using the bed-shaped mattress with the device according to the present invention.

Please refer to FIG. 5A, which shows a schematic diagram of turning on bed by using the bed-shaped mattress with the device according to the present invention.

As shown in FIG. 4A and FIG. 5A, according to the present embodiment, as the cantilever beam 16 of the device 1 stops at a proper height and the hooks 184*a* on the turning shafts 184 of the turn driving device 184 are connected to the bed-shaped mattress 2 shown in FIG. 4A via the slings 22, the motor reducer 180 can drive the revolutionary shaft 182 and the turning shafts 184 to turn, making the slings 22 to raise one side of the bed-shaped mattress 2 and lower the other side of the bed-shaped mattress 2. If the hooks 184*a* on the turning shafts 184 hook to the B pad lugs 202, the C pad lugs 202, the D pad lugs 202, and the E pad lugs 202 on the main pad 20*a* via the slings 22 and turn, the main pad 20*a* provides the patient to turn his whole body on the bed and thus changing the pressure point and preventing bedsores. If the hooks 184*a* on the turning shafts 184 hook to the A pad lugs 202 only via the slings 22, the patient can perform the partial movement of turning his head. If the hooks 184*a* on the turning shafts 184 hook to the B pad lugs 202 and the C pad lugs 202 only, the C pad lugs 202 and the D pad lugs 202 only, or the D pad lugs 202 and the E pad lugs 202 only via the slings 22, the patient can perform the partial movement of turning his chest, waist, or hips.

Figure 5B:
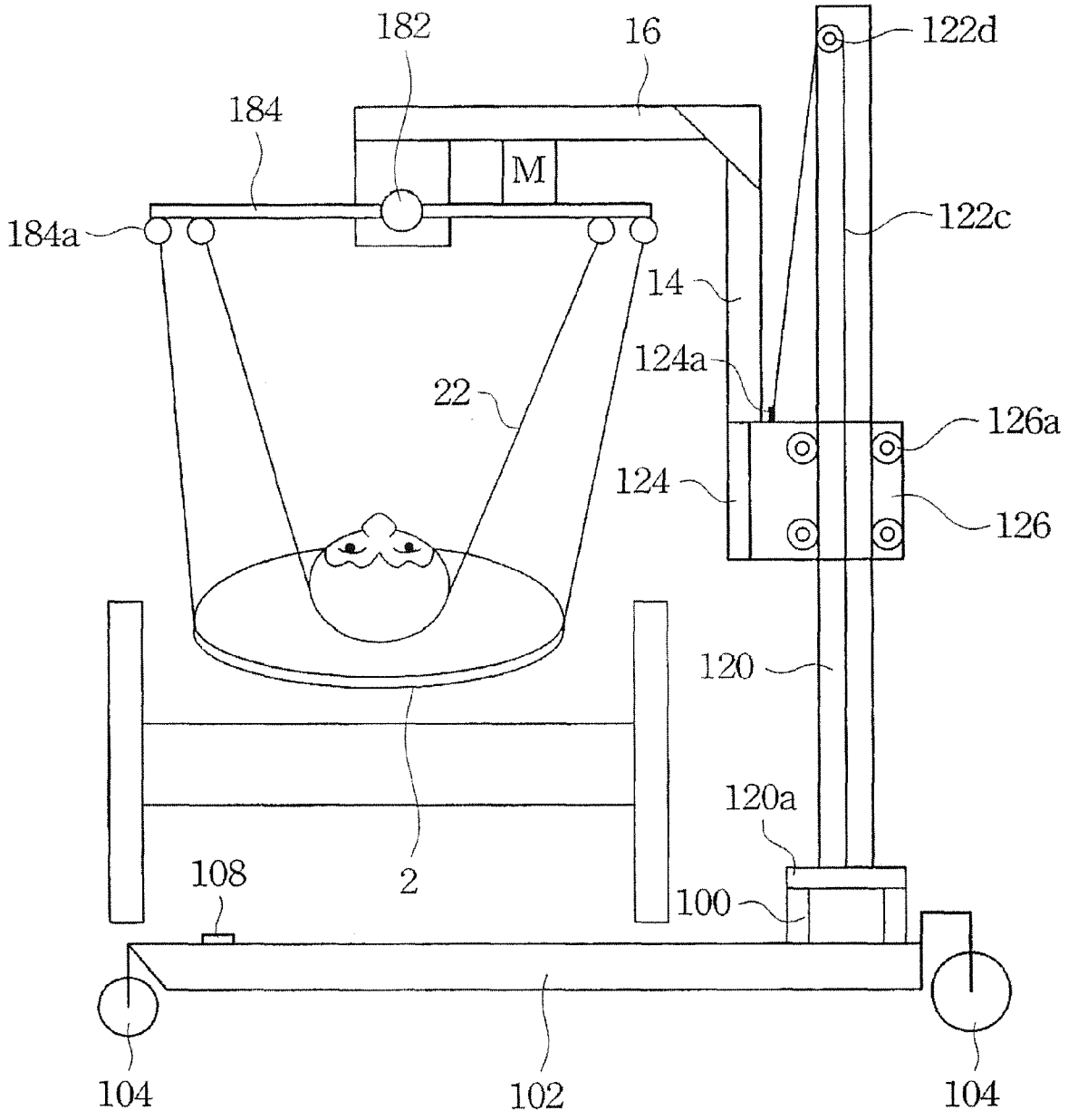
FIG. 5B shows a schematic diagram of slinging above bed by using the bed-shaped mattress with the device according to the present invention.

Please refer to FIG. 5B, which shows a schematic diagram of slinging above bed by using the bed-shaped mattress with the turning and lifting device according to the present invention.

As shown in FIG. 4A and FIG. 5A, according to the present embodiment, if the hooks 184*a* on the turning shafts 184 hook to the A pad lugs 202, the C pad lugs 202, the D pad lugs 202, and the E pad lugs 202 simultaneously via the slings 22, the device 1 can raise or lower the main pad 20*a* and the head pad 20*b* of the bed-shaped mattress 2 by adjusting the high and low displacement of the cantilever beam 16 for slinging the patient's body and facilitating adjusting the patient's position on bed or changing bed sheets. If the hooks 184*a* on the turning shafts 184 hook to the A pad lugs 202 only, the B pad lugs 202 and the C pad lugs 202 only, the C pad lugs 202 and the D pad lugs 202 only, or the D pad lugs 202 and the E pad lugs 202 only via the slings 22, the device 1 can raise or lower the specific portion of the main pad 20*a* and the head pad 20*b* of the bed-shaped mattress 2 by adjusting the high and low displacement of the cantilever beam 16 for performing partial body stretches such as raising head, chest, waist, and hips.

Figure 6A:
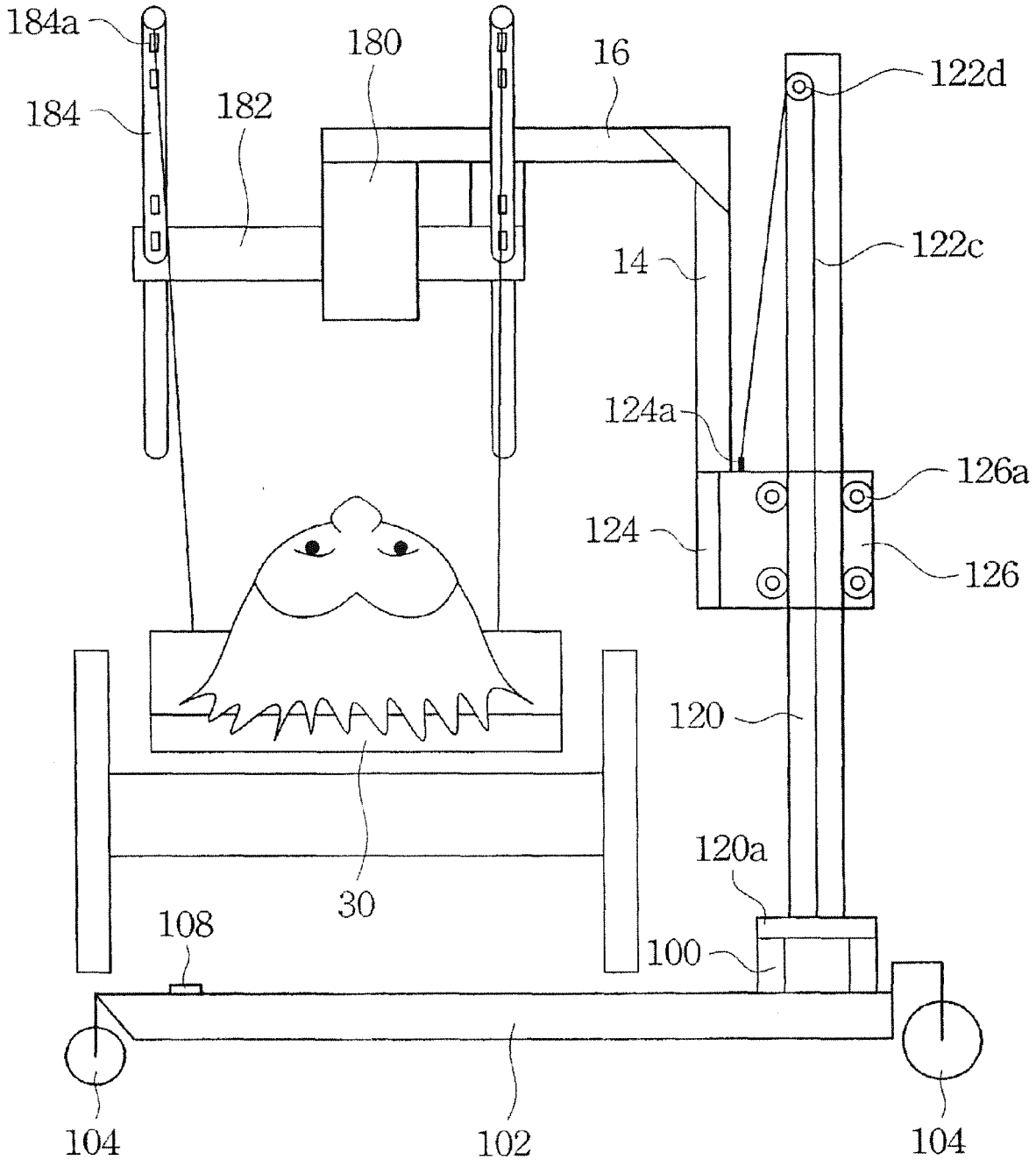
FIG. 6A shows a schematic diagram of washing hair on bed by using the hair-washing tray with the device according to the present invention.
Figure 6B:
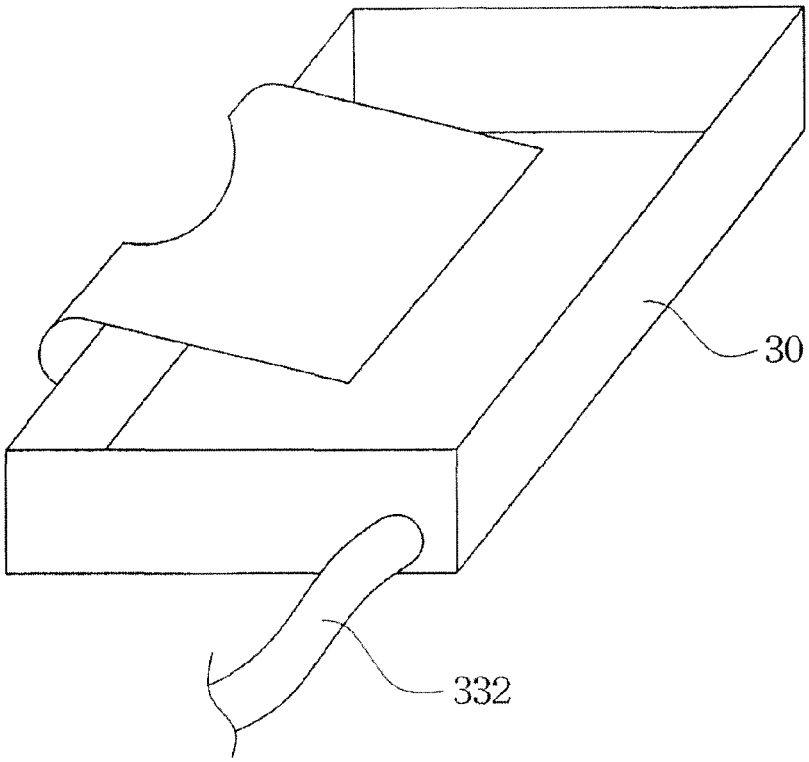
FIG. 6B shows a schematic diagram of the hair-washing tray in FIG. 6A.
Figure 6C:
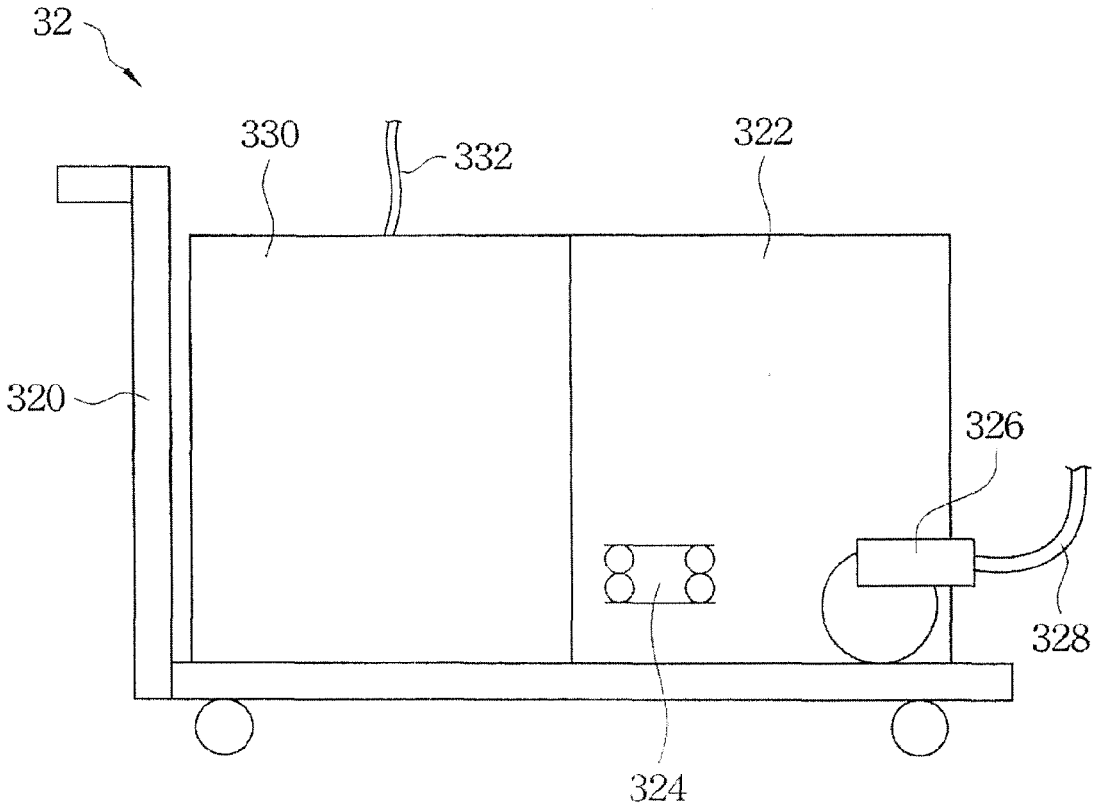
FIG. 6C shows a schematic diagram of the washing tools used by the hair-washing tray in FIG. 6A.

Please refer to FIGS. 6A, 6B, and 6C. FIG. 6A shows a schematic diagram of washing hair on bed by using the hair-washing tray with the device according to the present invention; FIG. 6B shows a schematic diagram of the hair-washing tray in FIG. 6A; and FIG. 6C shows a schematic diagram of the washing tools used by the hair-washing tray in FIG. 6A.

As shown in FIGS. 6A, 6B, and 6C, according to the present embodiment, when the cantilever beam 16 of the device 1 stops at a proper height and hooks 184*a* on the turning shafts 184 of the turn driving device 18 are connected to the B pad lugs 202 of the bed-shaped mattress 2 in FIG. 4A via the slings 22, the motor reducer 180 drives the revolutionary shaft 182 and the turning shafts 184 to turn. The slings 22 lift a potion of the main pad 20*a* and thus raising the patient's shoulder and placing the patient's head on the hair-washing tray 30 as shown in FIG. 6B. The washing tools 32 in FIG. 6C include a trolley 320, a water tank 322, a temperature-controlled geyser 324, a water pump 326, a supplying pipe 328, a waste water tank 330, and a drainpipe 332. The water tank 322 and the waste water tank 330 of the washing tools 32 are disposed on the trolley 320; the temperature-controlled geyser 324 and the water pump 326 of the washing tools 32 are disposed at the water tank 322. The temperature-controlled geyser 324 of the washing tools 32 is used for adjusting the temperature of the water tank 322; the water pump 326 guides the water in the water tank 322 to the hair-washing tray 30 via the supplying pipe 328. The waste water of washing the patient's hair is guided to the waste water tank 330 from the hair-washing tray 30 and via the drainpipe 332 of the washing tools 32. Thereby, by using the washing tools 32 together with the hair-washing tray 30, a patient's hair can be washed on bed with ease.

Figure 7A:
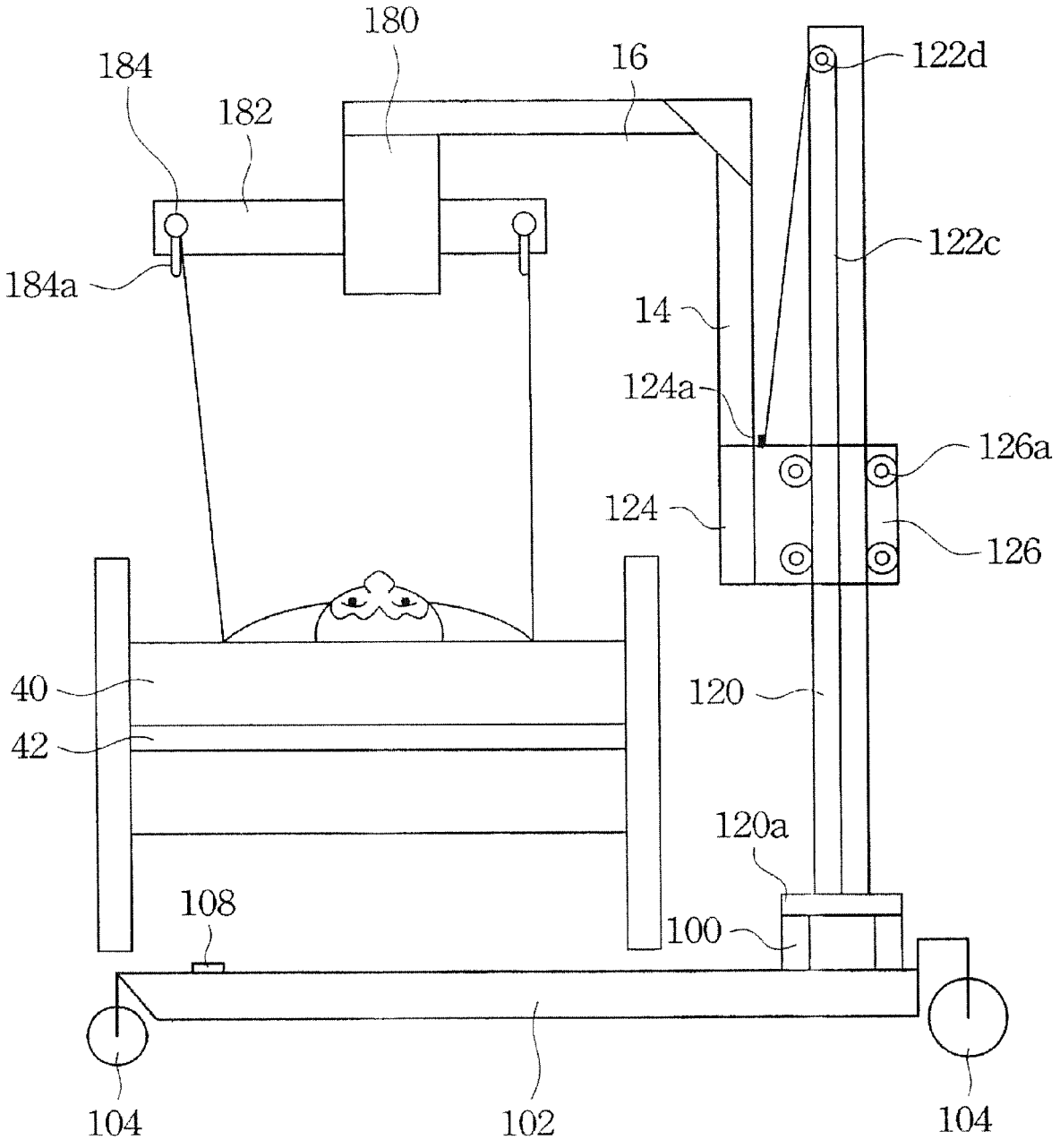
FIG. 7A shows a schematic diagram of bathing on bed by using the bathing tub with the device according to the present invention.
Figure 7B:
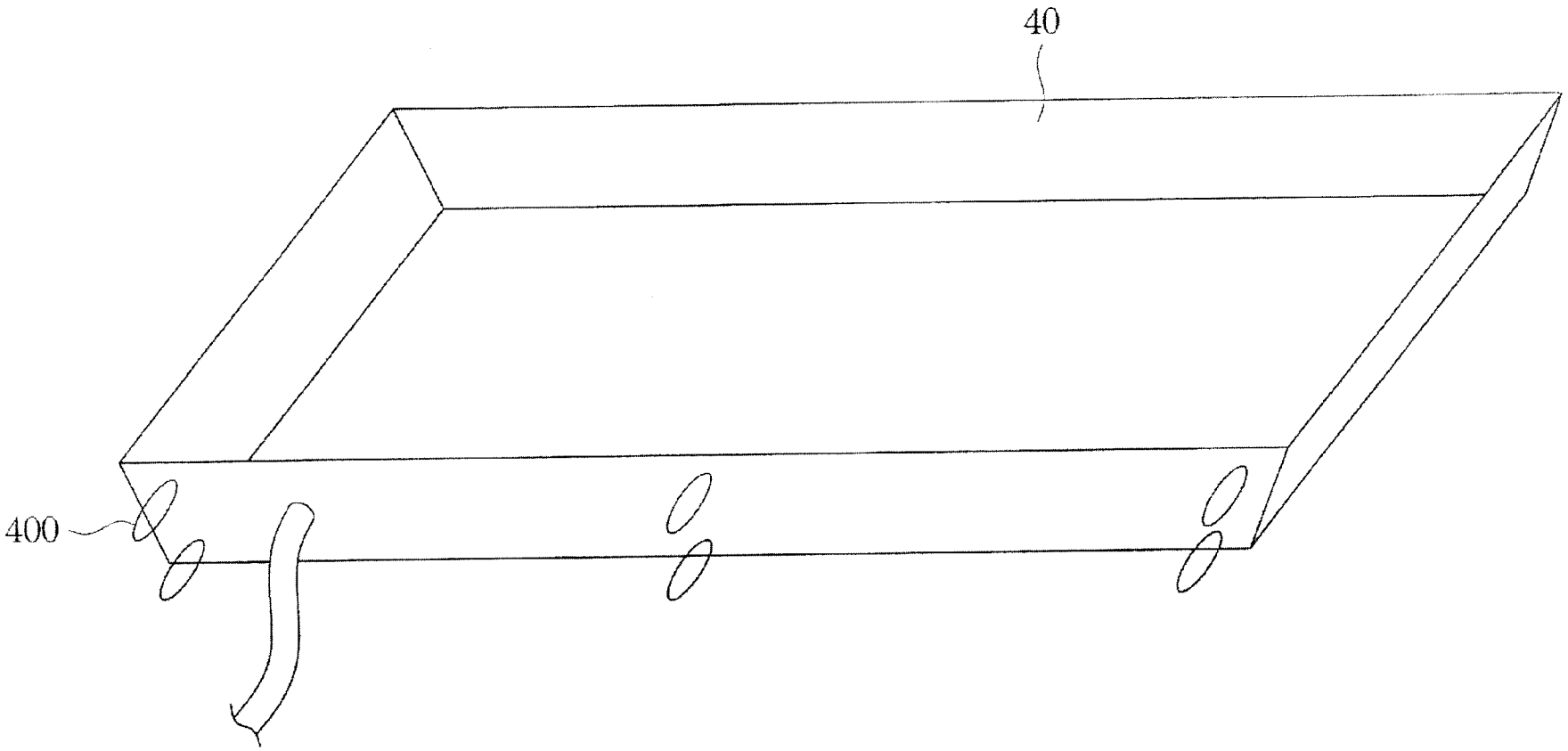
FIG. 7B shows a schematic diagram of the bathing tub in FIG. 7A.
Figure 7C:
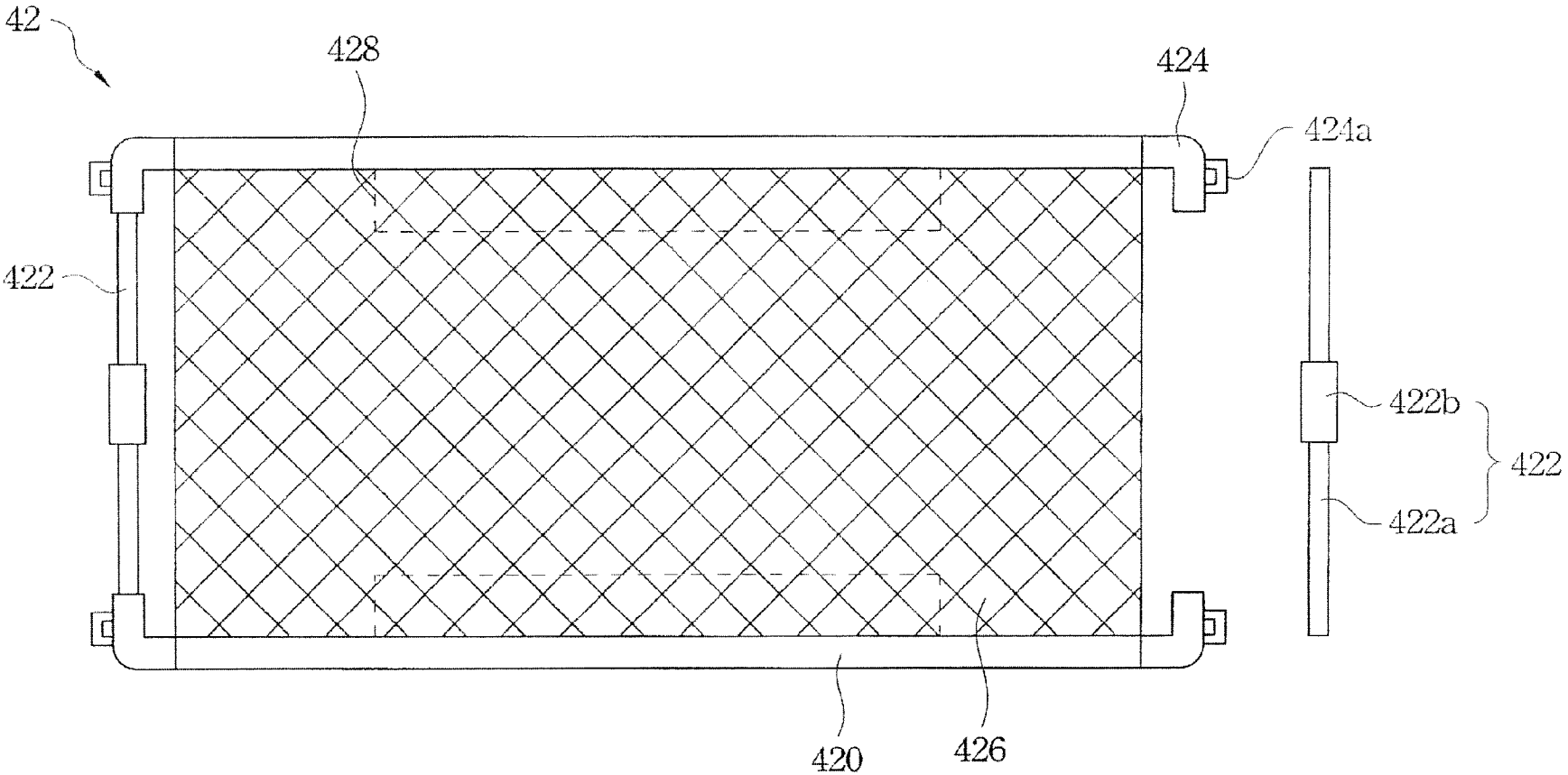
FIG. 7C shows a schematic diagram of the assembly frame used by the bathing tub in FIG. 7A.
Figure 7D:
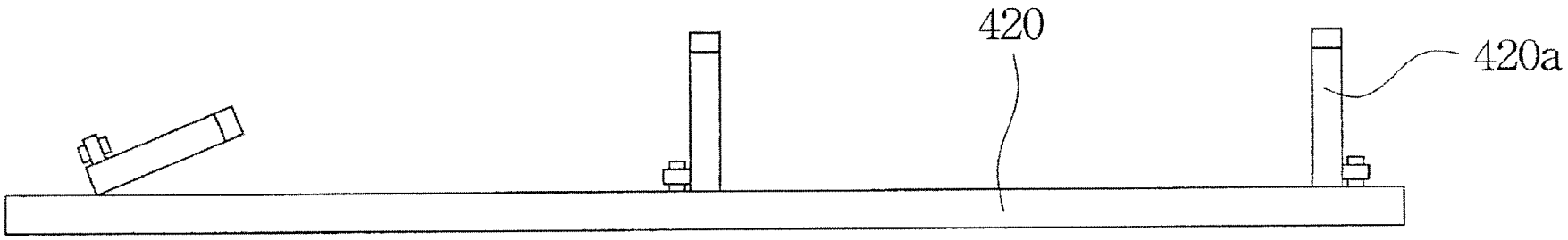
FIG. 7D shows a side view of the long crutch in FIG. 7C.

Please refer to FIGS. 7A to 7D. FIG. 7A shows a schematic diagram of bathing on bed by using the bathing tub 40 with device according to the present invention; FIG. 7B shows a schematic diagram of the bathing tub in FIG. 7A; FIG. 7C shows a schematic diagram of the assembly frame used by the bathing tub in FIG. 7A; and FIG. 7D shows a side view of the long crutch in FIG. 7C.

As shown in FIGS. 7A and 7B, according to the present embodiment, if the hooks 184*a* on the turning shaft 184 hook to the A pad lugs 202, the C pad lugs 202, the D pad lugs 202, and the E pad lugs 202 of the main pad 20*a* via the slings 22, then the device 1 can raise the bed-shaped mattress 2 by adjusting the heights of the cantilever beam 16 and thus placing the patient into the washing tub 40 in FIG. 7B.

As shown in FIGS. 7B, 7C, and 7C, the washing tub 40 is a rectangular tub formed by stitching nylon or similar waterproof materials. The washing tub 40 includes fixing bands 400 located at the tops and bottoms of the head, middle, and tail parts on both sides thereof. The assembly frame 42 includes long crutches 420, short crutches 422, bent joints 424, canvas 426, and bags 428. The assembly frame 42 is formed by two parallel short crutches 422 and two parallel long crutches 420; the bent joints 424 are used for connecting and locking between any two adjacent short crutches 422 and long crutches 420. In other words, one of the long crutches 420 and one of the short crutches 422 are connected and locked to both ends of one of the bent joints 424 and forming a closed frame. The canvas 42 of the assembly frame 42 is connected and spread between the two long crutches 420. Each short crutch 422 of the assembly frame 42 includes a telescopic casing 422*b* and two shafts 422*a*. The two shafts 422*a* of the short crutch 422 are connected and locked to both ends of the telescopic casing 422*b*. Besides, by locking into the telescopic casing 422*b*, the overall length of the short crutches 422 can be adjusted. Thereby, when the short crutches 422 are disassembled from the bent joints 424 and retracted, they can be held in the bags 428, and hence facilitating disassembling and storing of the assembly frame 42.

In addition, each long crutch 420 of the assembly frame 42 has fixing pillars 420*a* at its head, middle, and tail parts. The fixing pillars 420*a* can be folded with respect to the long crutches 420. The fixing bands 400 on both sides of the washing tub 40 can be thereby fixed to the corresponding pillars 420*a* of the long crutches 420. The bent joints 424 of the assembly frame 42 include frame lugs 424*a*. Hence, the assembly frame 42 of the washing tub 40 can be raised by lifting the frame lugs 424*a* of the bent joints 424 for draining water with ease. Then, by using the washing tools 32 in FIG. 6C, caregivers can wash a patient in the washing tub 40 on bed.

Figure 8A:
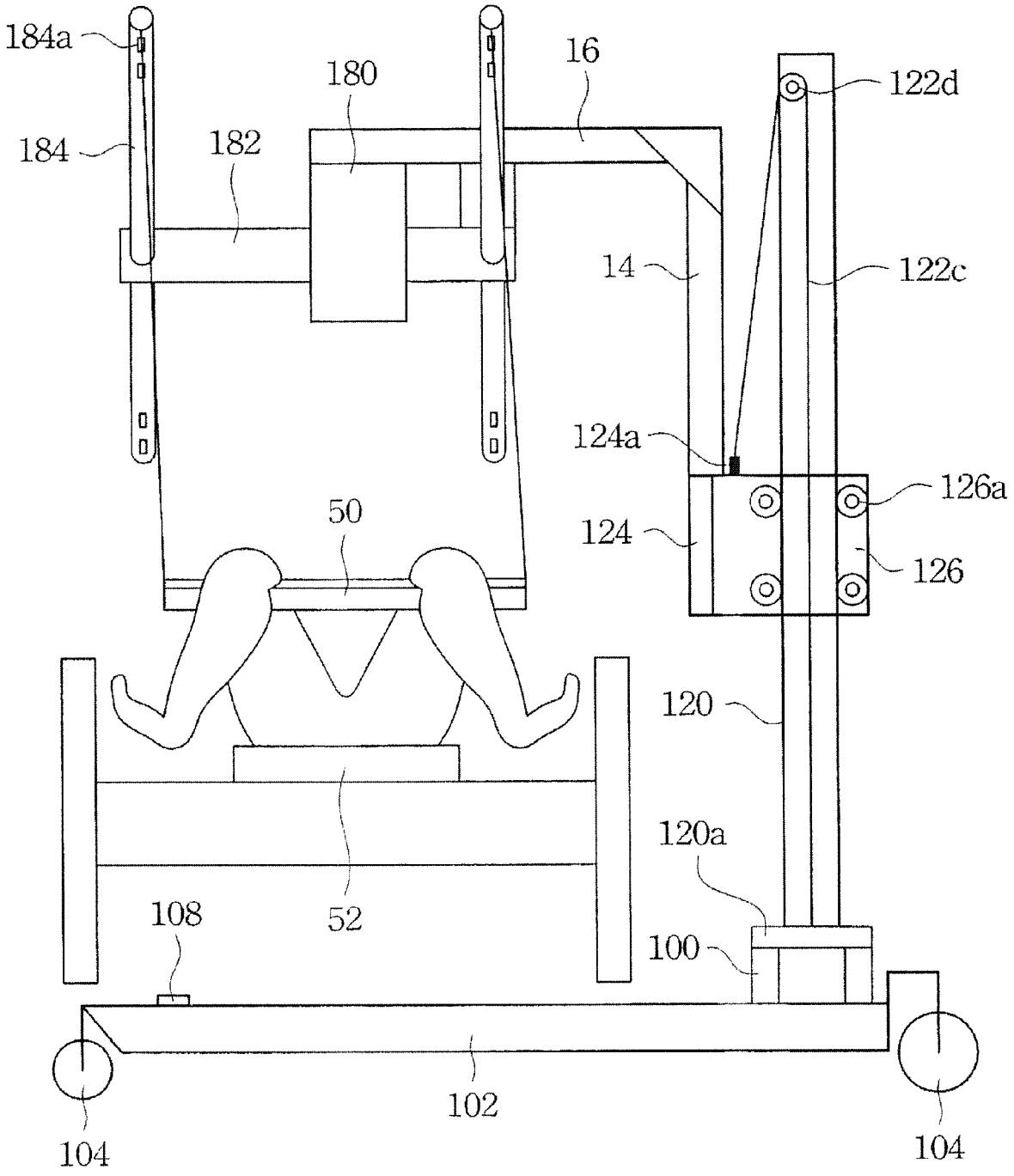
FIG. 8A shows a schematic diagram of washing bottom on bed by using the leg-lifting board and the bottom-washing tray with the device according to the present invention.
Figure 8B:
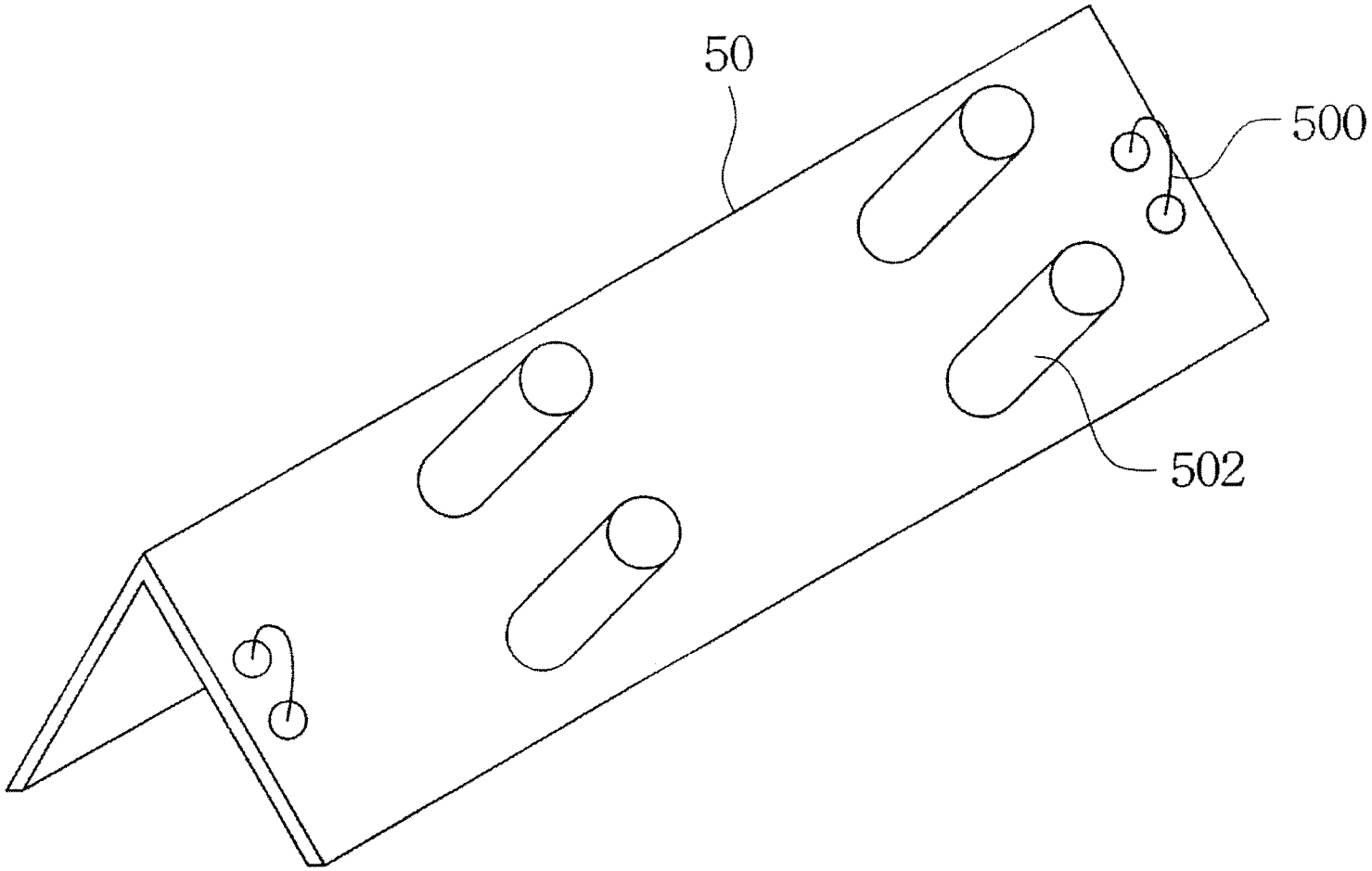
FIG. 8B shows a schematic diagram of the leg-lifting board in FIG. 8A.
Figure 8C:
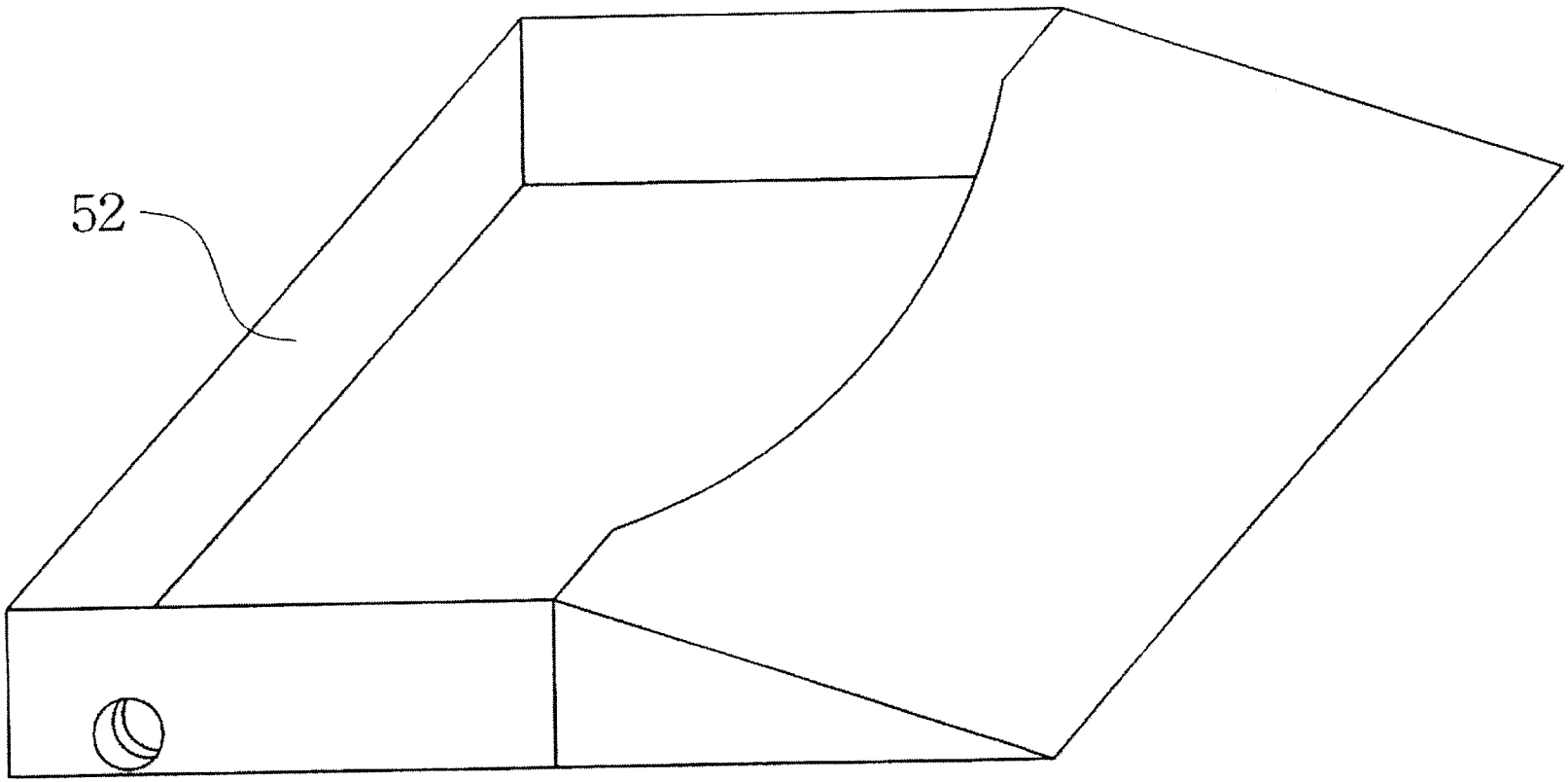
FIG. 8C shows a schematic diagram of the bottom-washing tray in FIG. 8A.

Please refer to FIGS. 8A to 8C. FIG. 8A shows a schematic diagram of washing bottom on bed by using the leg-lifting board and the bottom-washing tray with the turning and lifting device according to the present invention; FIG. 8B shows a schematic diagram of the leg-lifting board in FIG. 8A; and FIG. 8C shows a schematic diagram of the bottom-washing tray in FIG. 8A.

As shown in FIGS. 8A to 8C, according to the present embodiment, the leg-lifting board 50 includes lugs for leg-lifting board 500 and thigh-separating pillars 502. As the cantilever beam 16 of the device 1 stops at a proper height and the hooks 184*a* on the turning shaft 184 of the turn driving device 18 are connected to the lugs for leg-lifting board 500 of the leg-lifting board 50 shown in FIG. 8B via the slings 22, the motor reducer 180 can drive the revolutionary shaft 182 and the turning shaft 184 to turn. Thereby, the slings 22 lift the leg-lifting board 50 for lifting the patient's thighs and hips and placing the patient's hips on the bottom-washing tray 52. Accordingly, caregivers can clean the patient's fecal matters and change diapers on bed.

Figure 9A:
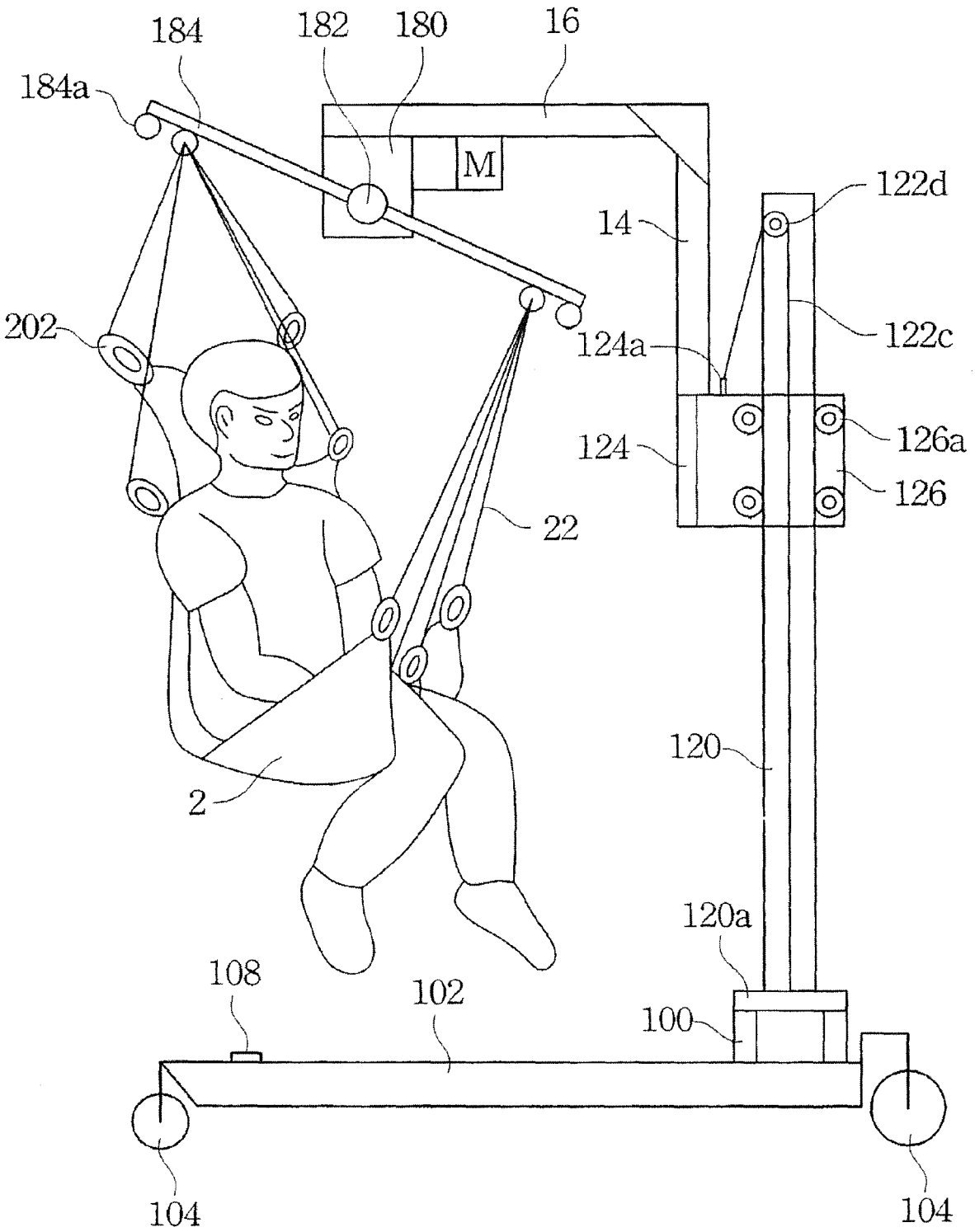
FIG. 9A shows a side view of slinging the wheelchair by using the bed-shaped mattress with the g device according to the present invention.
Figure 9B:
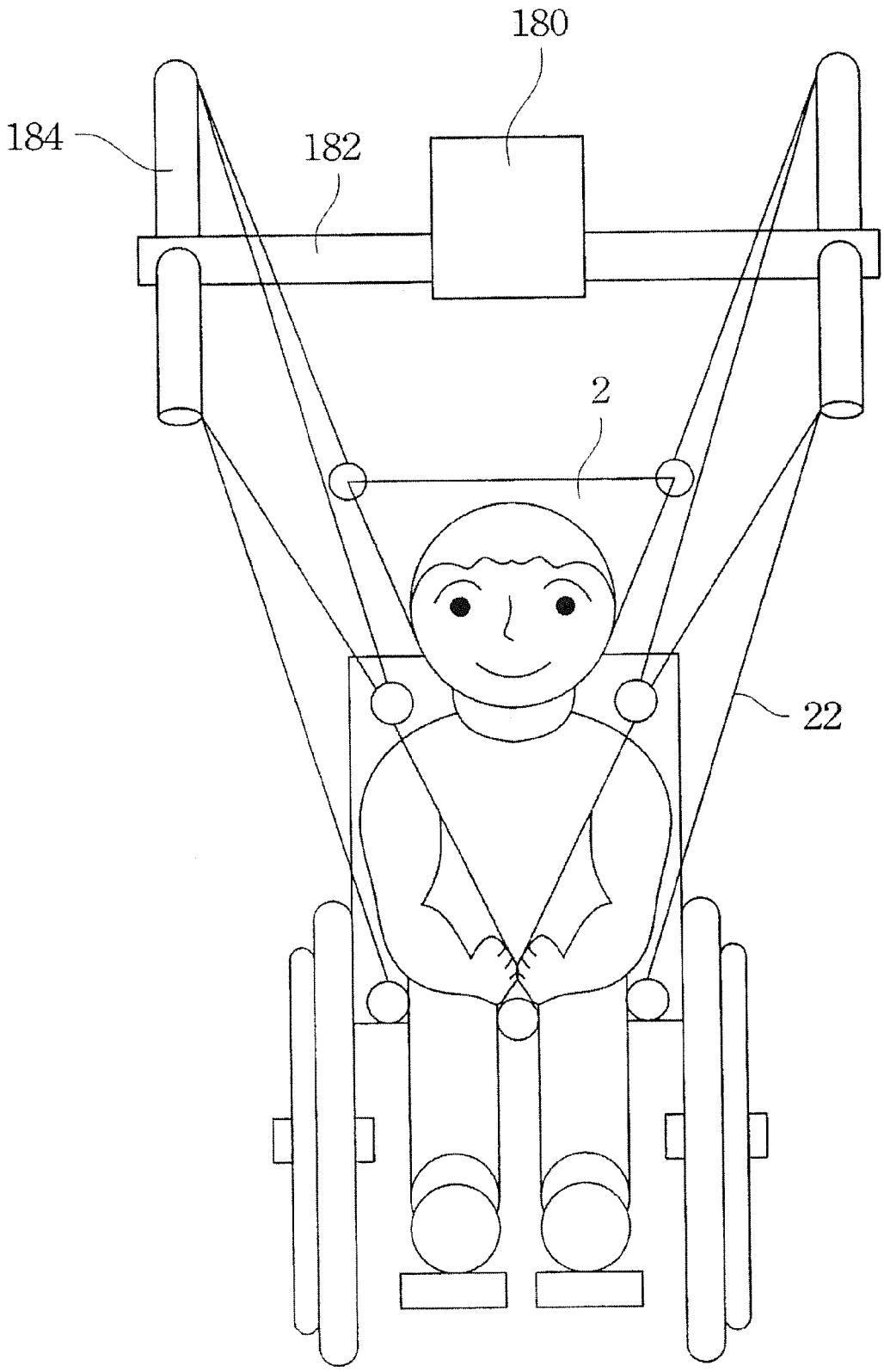
FIG. 9B shows a front view of slinging the wheelchair by using the bed-shaped mattress with the device in FIG. 9A.

Please refer to FIG. 9A and FIG. 9B. FIG. 9A shows a side view of slinging the wheelchair by using the bed-shaped mattress with the device according to the present invention; and FIG. 9B shows a front view of slinging the wheelchair by using the bed-shaped mattress with the device in FIG. 9A.

As shown in FIGS. 9A and 9B, according to the present embodiment, as the hook 184*a* on one end of the turning shaft 184 of the turn driving device 18 is connected to the A pad lugs 202 and the B pad lugs 202 of the bed-shaped mattress 2 in FIG. 4A via the slings 22 and the other hooks 184*a* on the other end of the turning shaft 184 is connected to the E pad lugs 202 and the F pad lugs 202 of the bed-shaped mattress 2 via the other sling 22, the motor reducer 180 can drive the turning shaft 184 to turn and adjust the height of the cantilever beam 16 for lifting the bed-shaped mattress 2 and enabling the patient to move above the vacant wheelchair in the sit position. The caregiver can stamp the pedal switches 108 of the base 10 to enable the lifting mechanism 12. By supporting the patient, the caregiver can operate the cantilever beam 16 to move up and down and place the bed-shaped mattress 2 by independent operations. Then the patient can sit to the wheelchair or be slung back to the bed stably.

Figure 10A:
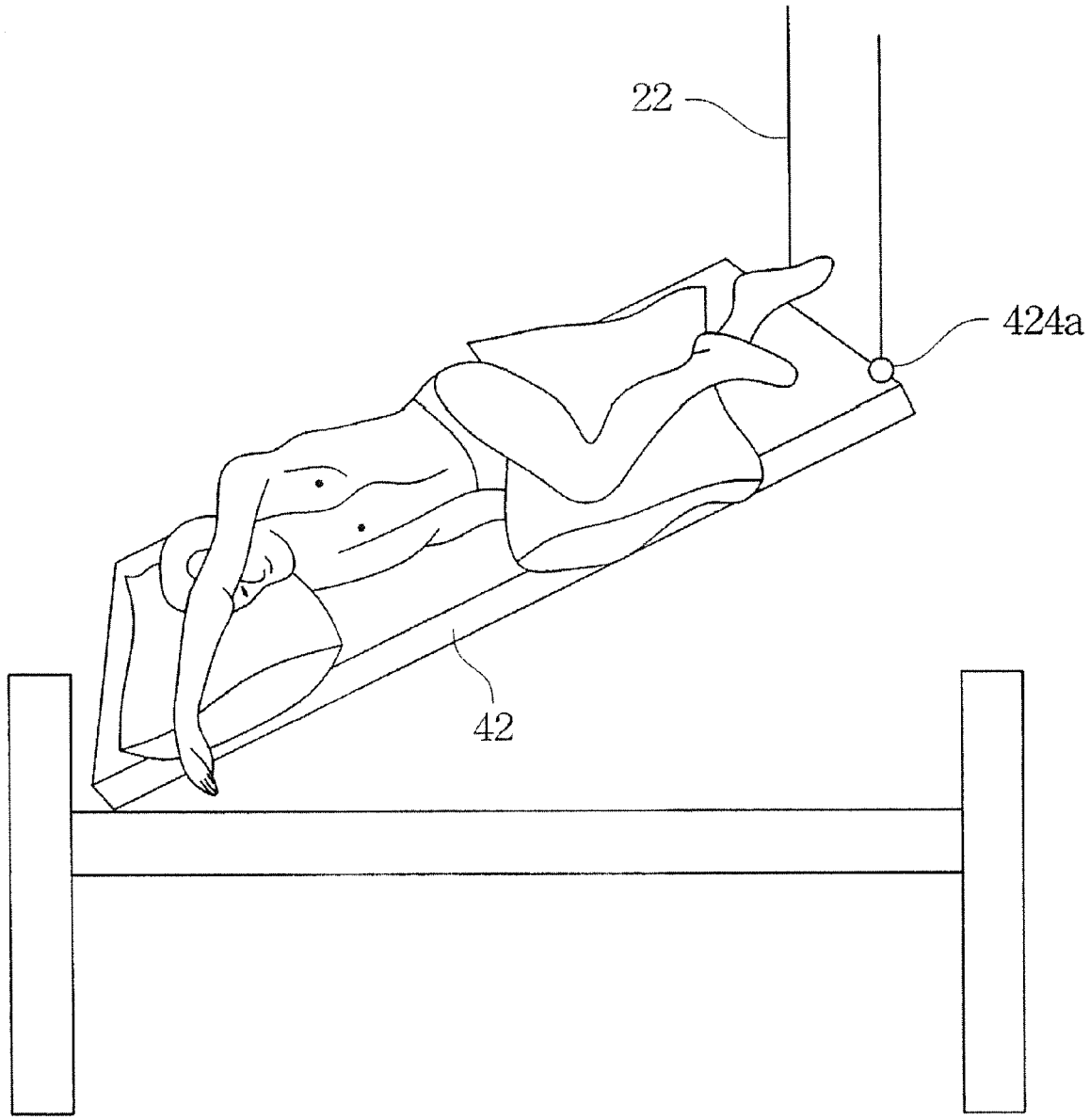
FIG. 10A shows a side view of expelling phlegm by using the assembly frame with the device according to the present invention.
Figure 10B:
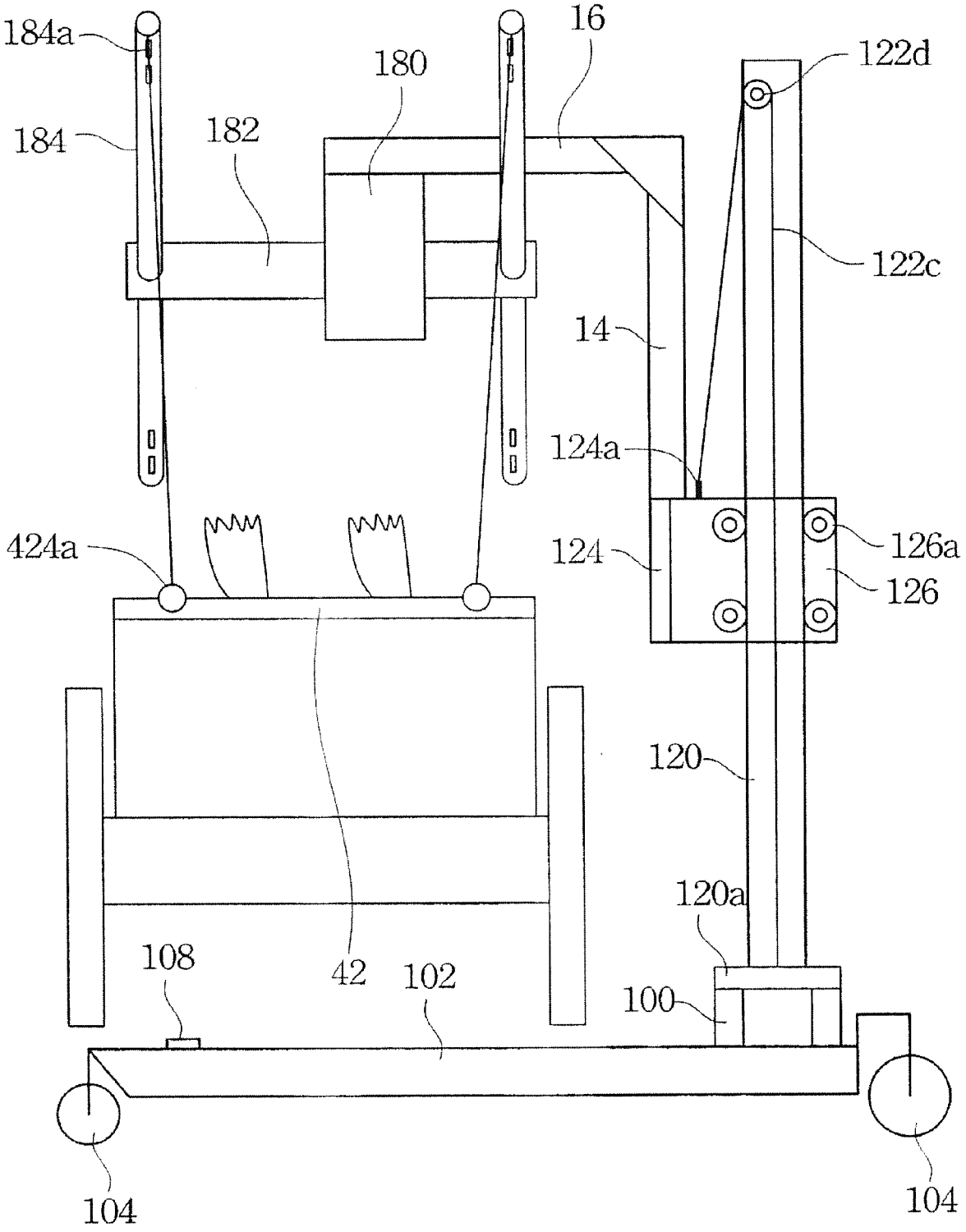
FIG. 10B shows a partial front view of expelling phlegm by using the assembly frame with the device in FIG. 10A.

Please refer to FIG. 10A and FIG. 10B. FIG. 10A shows a side view of expelling phlegm by using the assembly frame with the device according to the present invention; and FIG. 10B shows a partial front view of expelling phlegm by using the assembly frame with the t device in FIG. 10A.

As shown in FIGS. 10A and 10B, according to the present embodiment, when the cantilever beam of the device stops at a proper height, the assembly frame 42 in FIG. 7C is placed under the patient, who is in the left or right lying position, and the hooks 184*a* on the turning shaft 184 of the turn driving device 18 are connected to the frame lugs 424*a* of the assembly frame 42 via the slings 22, the motor reducer 180 can drive the revolutionary shaft 182 and the turning shaft 184 to turn. Thereby, the slings 22 can lift the assembly frame 42 to a proper angle, making the patient in a drainage position, in which the patient's head is low and the legs are high. Consequently, the caregiver can percuss the patient and help the patient to expel the deep accumulated phlegm to the mouth. Then the phlegm can be removed using a suction machine.

Figure 11:
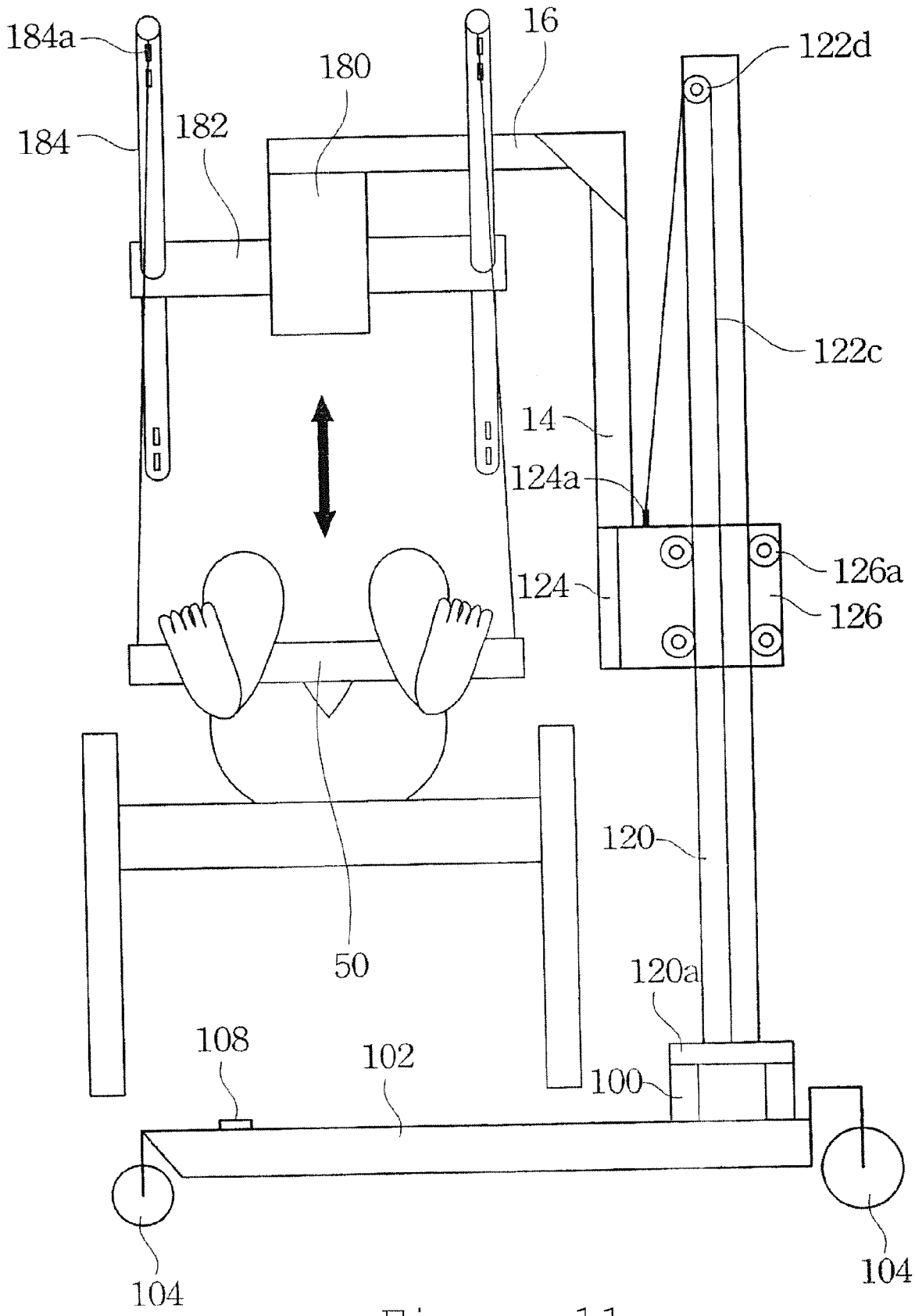
FIG. 11 shows a side view of leg rehabilitation on bed by using the leg-lifting board with the device according to the present invention.

Please refer to FIG. 11, which shows a side view of leg rehabilitation on bed by using the leg-lifting board with the device according to the present invention.

As shown in FIG. 11, according to the present embodiment, as the cantilever beam 16 of the device 1 stops at a proper height and the hooks 184*a* on the turning shaft 184 of the turn driving device 18 are connected to the leg-lifting-board lugs 500 of the leg-lifting board 50 in FIG. 8B via the slings 22, the motor reducer 180 can drive the revolutionary shaft 182 and the turning shaft 184 to turn and thus enabling the slings 22 to lift the leg-lifting board 50 under the patient's shanks. Thereby, the patient's legs can be lifted or lowered repeatedly for rehabilitation.

Figure 12:
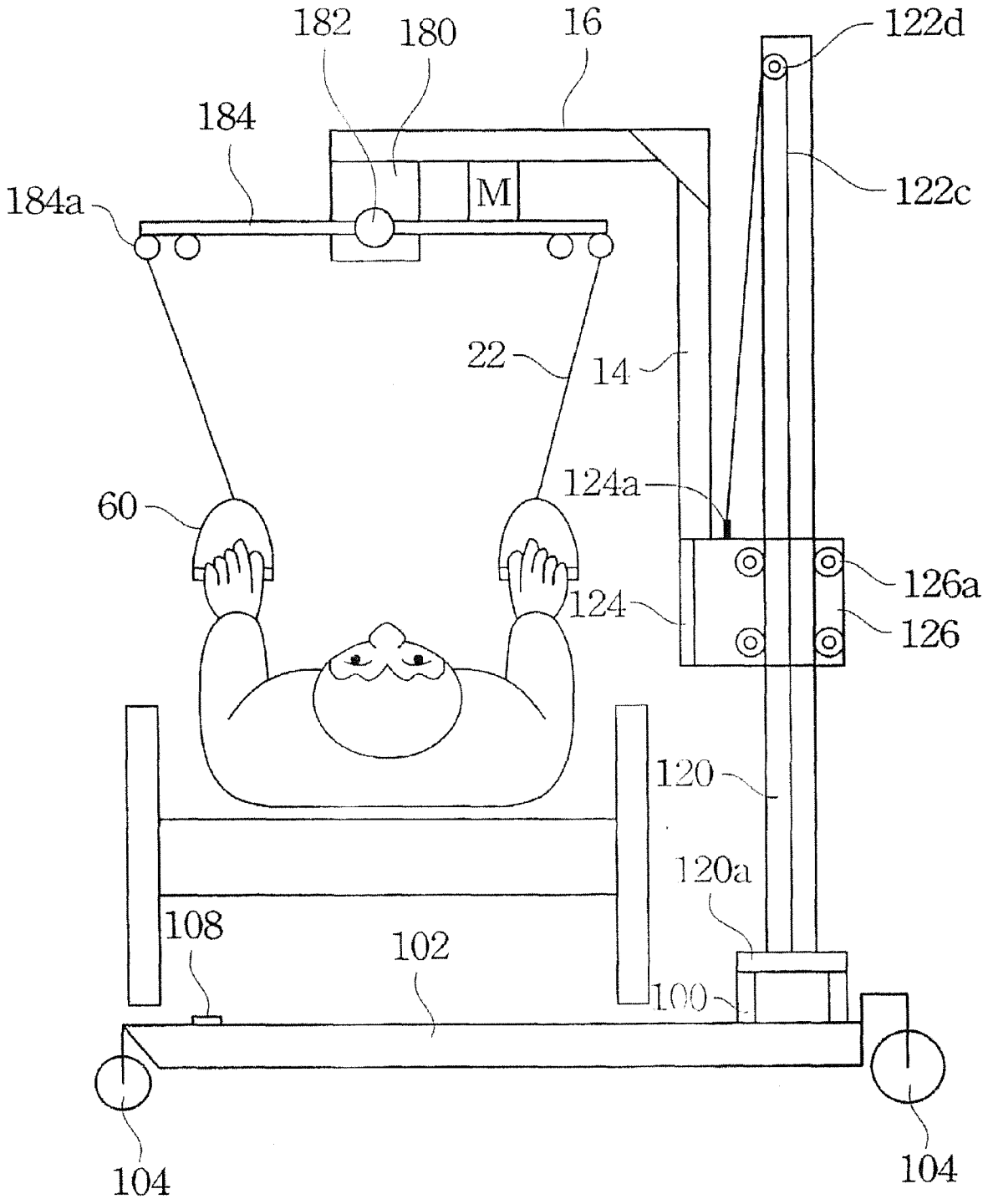
FIG. 12 shows a side view of hand rehabilitation on bed by using the pulling handle with the device according to the present invention.

Please refer to FIG. 12, which shows a side view of hand rehabilitation on bed by using the pulling handle with the device according to the present invention.

As shown in FIG. 12, according to the present embodiment, as the cantilever beam 16 of the device 1 stops at a proper height and the two hooks 184*a* on both ends of the turning shaft 184 of the turn driving device 18 are connected to the two pulling handles 60 via the slings 22, the motor reducer 180 can drive the revolutionary shaft 182 and the turning shaft 184 to turn and thus enabling the slings 22 to lift and lower the two pulling handles 60 alternately. Thereby, the patient's arms can be pulled and released alternately for rehabilitation.

Figure 13A:
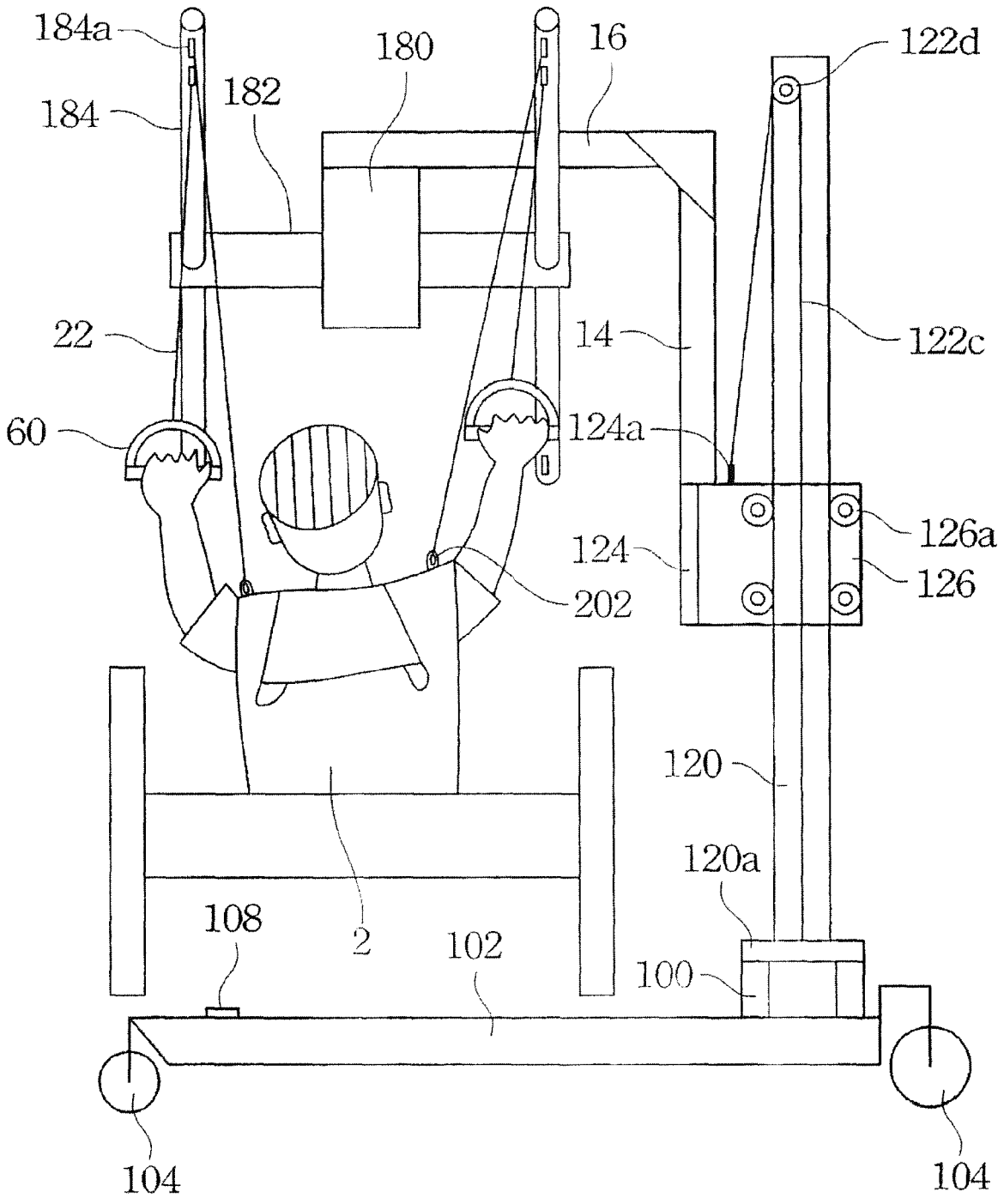
FIG. 13A shows a side view of sitting and lying rehabilitation on bed by using the bed-shaped mattress with the device according to the present invention.
Figure 13B:
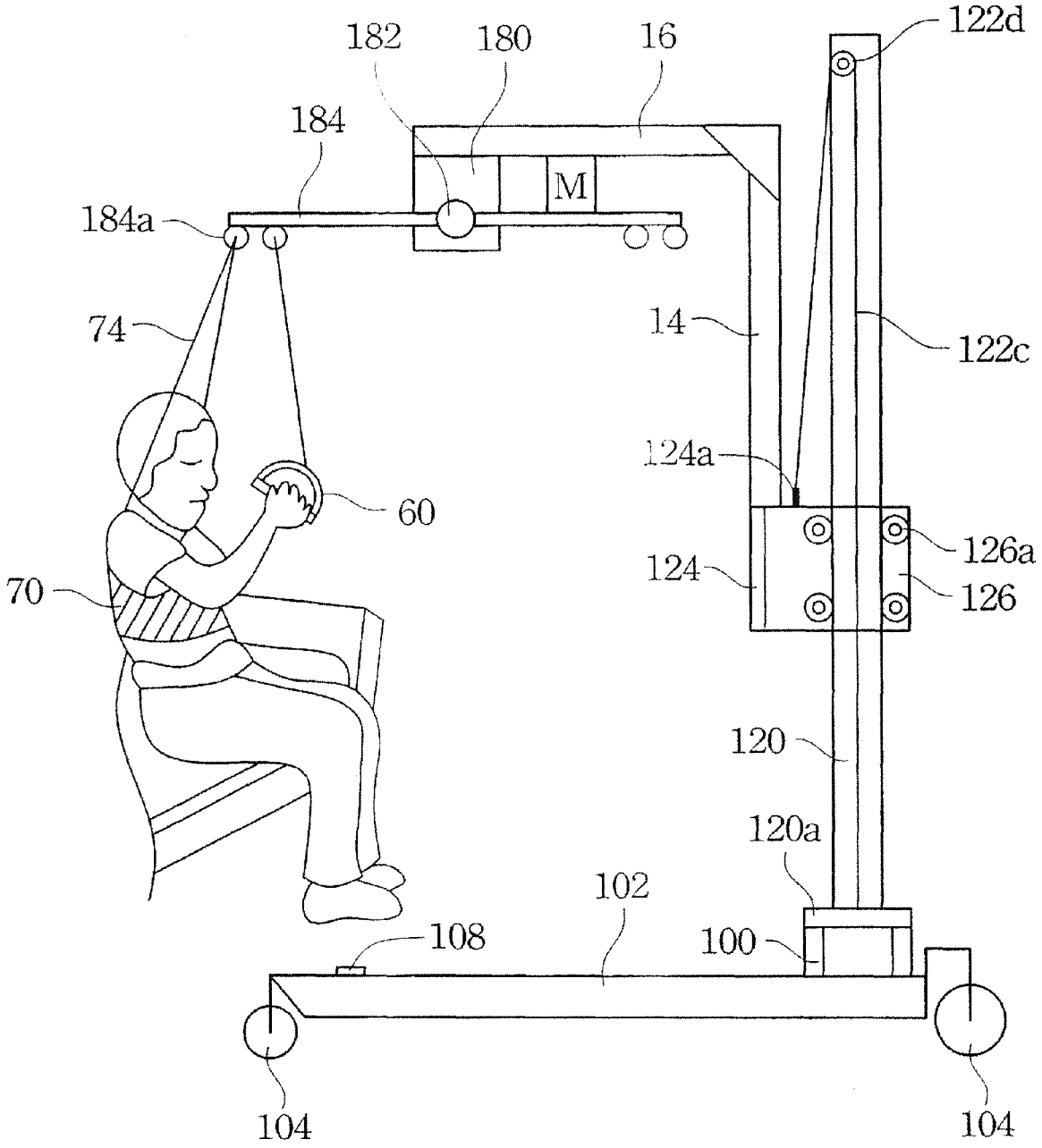
FIG. 13B shows a side view of standing-up and sitting-down rehabilitation on bed by using the vest sling with the device according to the present invention.

Please refer to FIG. 13A and FIG. 13B. FIG. 13A shows a side view of sitting and lying rehabilitation on bed by using the bed-shaped mattress with the device according to the present invention; and FIG. 13B shows a side view of standing-up and sitting-down rehabilitation on bed by using the vest sling with the device according to the present invention.

As shown in FIG. 13A, according to the present embodiment, as the cantilever beam of the device 1 stops at a proper height and the hooks 184*a* on the same ends of the two turning shafts 184 of the turn driving device 18 are connected to the B pad lugs 202 of the main pad 20*a* in FIG. 4A and to the pulling handle 60 in FIG. 12 via the slings 22, respectively, the motor reducer can drive the revolutionary shaft 182 and the turning shafts 184 to turn. Thereby, the slings 22 can lift the B pad lugs 202 and the pulling handle 60 simultaneously and thus helping the patient to perform the rehabilitation of sitting and lying.

As shown in FIG. 13B, according to the present embodiment, as the cantilever beam 16 of the device 1 stops at a proper height and the hooks 184*a* on the same ends of the two turning shafts 184 of the turn driving device 18 are connected to the vest sling 70 in FIG. 4B and to the pulling handle 60 in FIG. 12 via the chest slings 74 of the vest sling 70, the motor reducer can drive the revolutionary shaft 182 and the turning shafts 184 to turn. Thereby, the slings 22 can lift the vest sling 70 and the pulling handle 60 simultaneously and thus helping the patient to perform the rehabilitation of standing up and sitting down.

According to the detailed description of the embodiments of the present invention, obviously, the device for turning over and transferring the patient according to the present invention mainly comprises a base, a lifting mechanism, an extension arm, a cantilever beam, and a turn driving device, which can be disassembled and assembled. Specifically, the device for turning over and transferring the patient according to the present invention can switch between lateral (the left and right direction) and longitudinal (the head and leg direction) turning functions by means of the revolutionary shaft and the turning shafts contained in the turn driving device. In addition to being used with the bed-shaped mattress and the sling (including slings of various functions) described above, the device for turning over and transferring the patient according to the present invention can also be used with hooks (including hooks on the turning shafts and hooks on the slings), pulling handles, leg-lifting boards, bottom-washing tray, hair-washing tray, on-bed bathing tub, washing tools, assemble frames, vest slings. Furthermore, the device for turning over and transferring the patient according to the present invention has the hollow lifting socket around the lifting post to make the lifting socket move up and down between two ends of the lifting post. In compared with the method according to the prior art, which has the lifting frame moving up and down by slipping the top male shell into the bottom female shell as described above, the combination of the lifting socket and post according to the present invention can increase the lifting range effectively, and thus making it more suitable for practical applications.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A device for turning over and transferring a patient, comprising:

a base;

a lifting mechanism, including:

a lifting post fixed to said base; and a lift driving device fixed to said lifting post;

an extension arm, having a first end and a second end, said lift driving device operatively connected to said first end for driving said extension arm to move tip and down along said lifting post;

a cantilever beam, connected to said second end, and extending away from said lifting post;

a turn driving device, including:

a motor reducer including an electric motor, and being connected pivotally to said cantilever beam;

a revolutionary shaft, connected to said motor reducer, and driven by said motor reducer and turning about said motor reducer, said revolutionary shaft having opposing terminal ends;

two turning shafts, each turning shaft fixed on one of said terminal ends of said revolutionary shaft, respectively, and turning about said motor reducer along with said revolutionary shaft;

a bolt shaft extending vertically and parallel to said extension arm, said bolt shaft passing through said cantilever beam, said motor reducer connected pivotally with said cantilever beam via said bolt shaft, said revolutionary shaft passing through said motor reducer, and said revolutionary shaft and said motor reducer rotate together about said bolt shaft; and an orientation plug extending parallel to said bolt shaft, said orientation plug passing through said cantilever beam, and fixing a rotational angle between said motor reducer and said cantilever beam; and wherein each turning shaft is configured to move along the respective terminal end of the revolutionary shaft so as to adjust distances from the respective terminal end of the revolutionary shaft to opposing ends of the turning shaft such that a distance between the terminal end of the revolutionary shaft and one of the ends of the turning shaft is greater than a distance between the terminal end of the revolutionary shaft and the other one of the ends of the turning shaft, wherein said turning shafts each turn about said revolutionary shaft.

2. The device of claim 1, wherein said lifting mechanism further includes:

an insertion socket, said first end of said extension arm being inserted into said insertion socket, and said lift driving device connected to said insertion socket to drive said insertion socket to drive said extension arm to move up and down along said lifting post; and a lifting socket directly connected to and fixed relative to said insertion socket so as to move with said insertion socket as it is driven by said lift driving device, said lifting socket surrounding said lifting post such that said lifting post passes through said lilting socket.

3. A device for turning over and transferring a patient, comprising:

a base;

a lifting mechanism fixed to said base;

an extension arm, having a first end and a second end, and said first end operatively connected to said lifting mechanism;

a cantilever beam, connected to said second end, and extending away from said lifting post;

a turn driving device, including:

a motor reducer including an electric motor and being connected pivotally to said cantilever beam;

a revolutionary shaft connected to said motor reducer and driven by said motor reducer and turning about said motor reducer, said revolutionary shaft having opposing terminal ends;

two turning shafts, each turning shaft fixed on one of said terminal ends of said revolutionary shaft, respectively, and turning about said motor reducer along with said revolutionary shaft;

a bolt shaft extending vertically and parallel to said extension arm, said bolt shaft passing through said cantilever beam, said motor reducer connected pivotally with said cantilever beam via said bolt shaft, said revolutionary shaft passing through said motor reducer, and said revolutionary shaft and said motor reducer rotate together about said bolt shaft; and an orientation plug extending parallel to said bolt shaft, said orientation plug passing through said cantilever beam, and fixing a rotational angle between said motor reducer and said cantilever beam;

wherein each turning shaft is configured to move along the respective terminal end of the revolutionary shaft so as to adjust distances from the respective terminal end of the revolutionary shaft to opposing ends of the turning shaft such that a distance between the terminal end of the revolutionary shaft and one of the ends of the turning shaft is greater than a distance between the terminal end of the revolutionary shaft and the other one of the ends of the turning shaft, wherein said turning shafts each turn about said revolutionary shaft; and a bed-shaped mattress, comprising a main pad and a head pad, said head pad connected to an edge of said main pad, said main pad and said head pad comprising a plurality of pairs of pad lugs, each pair of said pad lugs disposed symmetrically on opposing sides of said main pad or said head pad, respectively, and wherein each pair of said pad lugs is configured to be slung selectively to said turning shafts via at least a sling.

4. The device of claim 3, wherein said turning shafts include a plurality of hooks, and each pair of said pad lugs is configured to be slung selectively to any hook of said plurality of hooks.

5. The device of claim 3, wherein said head pad is configured to be folded to the back of said main pad and fixed by adhesion.

6. The device of claim 3, wherein said main pad and said head pad include a plurality of stitched reinforcing bands and said plurality of pairs of pad lugs are disposed on said plurality of reinforcing bands.

7. A device for turning over and transferring the patient, comprising:

a base;

a lifting mechanism, including:

a lifting post, fixed to said base; and a lift driving device, fixed to said lifting post;

an extension arm, having a first end and a second end, and said first end operatively connected to said lifting mechanism;

a cantilever beam, connected to said second end, and extending away from said lifting post;

a turn driving device, including:

a motor reducer including an electric motor and being connected pivotally to said cantilever beam;

a revolutionary shaft connected to said motor reducer and driven by said motor reducer and turning about said motor reducer, said revolutionary shaft having opposing terminal ends; and two turning shafts, each turning shaft fixed on one of said terminal ends of said revolutionary shaft, respectively, and turning about said motor reducer along with said revolutionary shaft;

a bolt shaft extending vertically and parallel to said extension arm, said bolt shaft passing through said cantilever beam, said motor reducer connected pivotally with said cantilever beam via said bolt shaft, said revolutionary shaft passing through said motor reducer, and said revolutionary shaft and said motor reducer rotate together about said bolt shaft; and an orientation plug extending parallel to said bolt shaft, said orientation plug passing through said cantilever beam, and fixing a rotational angle between said motor reducer and said cantilever beam; and wherein each turning shaft is configured to move along the respective terminal end of the revolutionary shaft so as to adjust distances from the respective terminal end of the revolutionary shaft to opposing ends of the turning shaft such that a distance between the terminal end of the revolutionary shaft and one of the ends of the turning shaft is greater than a distance between the terminal end of the revolutionary shaft and the other one of the ends of the turning shaft, wherein said turning shafts each turn about said revolutionary shaft;

an assembly frame, including a plurality of fixing pillars and a plurality of frame lugs, and said plurality of frame lugs slung to said turning shafts via at least a sling; and a bathing tub, including a plurality of fixing bands, and each fixing band being fixed to a corresponding fixing pillar of said plurality of fixing pillars.

8. The device of claim 7, wherein said assembly frame includes:

a plurality of long crutches, each pillar of said plurality of fixing pillars being disposed on a corresponding long crutch of said plurality of long crutches and each pillar being foldable with respect to said corresponding long crutch;

a plurality of short crutches; and a plurality of bent joints each having two ends, each of said plurality of frame lugs being disposed on a corresponding bent joint of said plurality of bent joints, and both ends of each of said bent joints of said plurality of bent joints lock one of said plurality of long crutches with one of said plurality of short crutches, respectively.

9. The device of claim 8, wherein each of said plurality of short crutches includes:

a telescopic casing; and two shafts locked to opposing ends of said telescopic casing, respectively, and being configured to adjust a length of said short crutch.

* * * * *